US010794622B2

(12) United States Patent
Jeong et al.

(10) Patent No.: US 10,794,622 B2
(45) Date of Patent: Oct. 6, 2020

(54) REFRIGERATOR

(71) Applicant: SAMSUNG ELECTRONICS CO., LTD., Suwon-si, Gyeonggi-do (KR)

(72) Inventors: Jin Jeong, Yongin-si (KR); Bong Su Son, Cheonan-si (KR); Do Yun Jang, Suwon-si (KR); Yoon Young Kim, Suwon-si (KR); Yong Jong Park, Seongnam-si (KR); Moon Gyo Jung, Suwon-si (KR); Kook Jeong Seo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/448,558

(22) Filed: Jun. 21, 2019

(65) Prior Publication Data

US 2019/0310006 A1 Oct. 10, 2019

Related U.S. Application Data

(62) Division of application No. 15/291,526, filed on Oct. 12, 2016, now Pat. No. 10,365,026.

(30) Foreign Application Priority Data

Oct. 14, 2015 (KR) ..... 10-2015-0143155

(51) Int. Cl.
*F25C 1/24* (2018.01)
*F25C 1/25* (2018.01)
(Continued)

(52) U.S. Cl.
CPC ..... *F25C 1/24* (2013.01); *F25C 1/25* (2018.01); *F25C 5/182* (2013.01); *F25C 5/22* (2018.01);
(Continued)

(58) Field of Classification Search
CPC ..... F25C 1/25; F25C 2400/06; F25C 5/22; F25C 5/24; F25C 1/24; F25C 5/182; F25C 2400/14; F25D 2323/122
See application file for complete search history.

(56) References Cited

U.S. PATENT DOCUMENTS 3,572,053 A 3/1971 Jacobus
3,602,007 A 8/1971 Drieci
(Continued)

FOREIGN PATENT DOCUMENTS

CN 1598454 3/2005
CN 103185431 7/2013
(Continued)

OTHER PUBLICATIONS

Chinese Office Action dated Sep. 4, 2019 in Chinese Patent Application No. 201680042309.4.
(Continued)

*Primary Examiner* — Cassey D Bauer
(74) *Attorney, Agent, or Firm* — Staas & Halsey LLP

(57) ABSTRACT

A water pocket with an open top side is filled with water, mounted in a regular position on a supporting frame, and tilts to supply the water stored in the water pocket to an ice making tray, thereby easily supplying a required amount of water to the ice making tray. A refrigerator includes an ice making tray provided to linearly move with rotation when ice of the ice making tray is separated, or includes a holding preventing member which prevents the ice from being caught by a lower ice making tray, thereby improving a forward-and-backward width of an ice maker. It is possible to easily withdraw ice stored in an ice bucket by pushing an ice discharge button in a state in which the ice bucket is not separated.

13 Claims, 38 Drawing Sheets

(51) Int. Cl.
*F25C 5/20* (2018.01)
*F25C 5/182* (2018.01)

(52) U.S. Cl.
CPC ..... *F25C 5/24* (2018.01); *F25C 2305/022* (2013.01); *F25C 2400/06* (2013.01); *F25C 2400/10* (2013.01); *F25C 2400/14* (2013.01); *F25D 2323/021* (2013.01)

(56) References Cited

U.S. PATENT DOCUMENTS

| | | | | |
|---|---|---|---|---|
| 3,747,363 | A | 7/1973 | Grimm | |
| 3,747,810 | A | 7/1973 | Graser | |
| 4,209,999 | A | 7/1980 | Falk | |
| 4,227,383 | A | 10/1980 | Horvay | |
| 4,306,757 | A | 12/1981 | Horvay | |
| 5,029,737 | A | 7/1991 | Yamamoto | |
| 5,860,564 | A | 1/1999 | Jablonski | |
| 6,135,173 | A | 10/2000 | Lee | |
| 7,997,452 | B2 | 8/2011 | Kim | |
| 8,196,618 | B2 | 6/2012 | Kim | |
| 8,333,223 | B2 | 12/2012 | Seo | |
| 8,544,291 | B2 | 10/2013 | Kim | |
| 8,820,583 | B2 | 9/2014 | Kim | |
| 2005/0056043 | A1 | 3/2005 | Lee | |
| 2009/0178431 | A1* | 7/2009 | Cho | F25C 1/04 62/345 |
| 2009/0205358 | A1 | 8/2009 | Smith | |
| 2010/0101261 | A1 | 4/2010 | Yoon et al. | |
| 2010/0200621 | A1 | 8/2010 | Buchstab | |
| 2010/0218525 | A1 | 9/2010 | Woo | |
| 2010/0224279 | A1 | 9/2010 | Chou | |
| 2010/0281908 | A1 | 11/2010 | Kim | |
| 2010/0319388 | A1 | 12/2010 | Yang | |
| 2011/0011116 | A1* | 1/2011 | Kim | F25C 1/04 62/347 |
| 2016/0273820 | A1* | 9/2016 | Celik | F25D 11/02 |
| 2016/0370102 | A1 | 12/2016 | Yang | |
| 2017/0108258 | A1 | 4/2017 | Jeong | |

FOREIGN PATENT DOCUMENTS

| | | |
|---|---|---|
| EP | 1519131 | 3/2005 |
| JP | S50-13269 | 2/1975 |
| JP | S50-19067 | 3/1975 |
| JP | S50-62754 | 6/1975 |
| KR | 10-0195450 | 6/1999 |
| KR | 20-0359348 | 8/2004 |
| KR | 10-0714559 | 4/2007 |
| KR | 10-2009-0004163 | 1/2009 |
| KR | 10-2009-0131744 | 12/2009 |
| KR | 10-2012-0043290 | 5/2012 |
| KR | 10-2013-0128563 | 11/2013 |
| KR | 10-2014-0003792 | 1/2014 |
| KR | 10-1396973 | 5/2014 |

OTHER PUBLICATIONS

International Search Report dated Dec. 14, 2016 from International Patent Application No. PCT/KR2016/011467, 3 pages.
Australian Office Action dated Nov. 9, 2018 in Australian Patent Application No. 2016339616.
Extended European Search Report dated May 28, 2018 in European Patent Application No. 16855724.7.
Australian Office Action dated Apr. 8, 2019 in Australian Patent Application No. 2016339616.
Machine Translation of JPS50-19067, Translated Jan. 19, 2019 (Year: 2019).
US Office Action dated May 7, 2018 in U.S. Appl. No. 15/291,526.
US Office Action dated Jun. 20, 2018 in U.S. Appl. No. 15/291,526.
US Office Action dated Jan. 24, 2019 in U.S. Appl. No. 15/291,526.
US Notice of Allowance dated Mar. 26, 2019 in U.S. Appl. No. 15/291,526.
U.S. Appl. No. 15/291,526, filed Oct. 12, 2016, Jin Jeong, et al., Samsung Electronics Co., Ltd.
European Office Action dated Jan. 30, 2020 in European Patent Application 16855724.7.
Chinese Office Action dated May 20, 2020 in Chinese Patent Application No. 201680042309.4.

* cited by examiner

REFRIGERATOR

CROSS-REFERENCE TO RELATED APPLICATIONS

This application is a divisional application of U.S. patent application Ser. No. 15/291,526, filed on Oct. 12, 2016, which claims the priority benefit of Korean Patent Application No. 10-2015-0143155, filed on Oct. 14, 2015, in the Korean Intellectual Property Office, the disclosures of which are incorporated herein by reference in their entirety.

BACKGROUND

1. Field

Embodiments of the disclosure relate to a refrigerator having a manual ice maker.

2. Description of the Related Art

A refrigerator is an apparatus which includes a body, a door, a storage compartment formed between the body and the door, and a cool air supply device which supplies cool air to the storage compartment to keep food fresh. The compartment includes a refrigerating compartment maintained at a temperature from about 0° C. to 5° C. to keep food under refrigeration and a freezing compartment maintained at a temperature from about 0° C. to −30° C. to keep food frozen.

A refrigerator may include an ice maker which makes ice. An ice maker may include an ice making tray in which water is stored and frozen to make ice, and an ice bucket which stores ice from the ice making tray.

Ice makers may be classified into automatic ice makers that automatically perform each process including a water supplying process of supplying water to an ice making tray, an ice making process of making ice by cooling the water stored in the ice making tray, an ice moving process of moving the ice that has been made from the ice making tray to an ice bucket, and an ice dispensing process of dispensing the ice from the ice bucket, and manual ice makers that manually perform the processes.

A process of supplying water to an ice making tray of a manual ice maker includes operations of taking an ice making tray from an ice making tray mounting portion, pouring water in the ice making tray so that the water does not overflow, and re-mounting the ice making tray storing water on the ice making tray mounting portion. Accordingly, it is not easy to supply the right amount of water to the ice making tray, and the water may overflow or splash during a process of pouring the water.

In a manual ice maker in which a plurality of ice making trays are vertically arranged, ice moved from an upper ice making tray may be caught by a lower ice making tray and not be put into an ice bucket. To prevent this, there is a structure in which a plurality of ice making trays are arranged forward and backward while being slightly shifted with respect to each other. However, due to the structure, front and rear widths of the ice maker are unnecessarily increased.

The ice bucket is entirely separated from the body or the door on which the ice bucket is mounted when withdrawing ice stored in the ice bucket of the ice maker, and then the ice is withdrawn.

SUMMARY

Additional aspects and/or advantages will be set forth in part in the description which follows and, in part, will be apparent from the description, or may be learned by practice of the disclosure.

Therefore, it is an aspect of the disclosure to provide a manual ice maker with an improved structure for supplying water to an ice making tray.

It is another aspect of the disclosure to provide a manual ice maker with an improved structure for moving ice from an ice making tray and a decreased thickness.

It is another aspect of the disclosure to provide a manual ice maker with an improved structure for withdrawing ice from an ice bucket.

Additional aspects of the disclosure will be set forth in part in the description which follows and, in part, will be apparent from the description, or may be learned by practice of the disclosure.

In accordance with an aspect of the disclosure, a refrigerator may include a body, a door, a storage compartment formed by the body and the door, and an ice bucket provided in the storage compartment to store ice. Here, the ice bucket may include an ice bucket body including an outlet, an ice discharge button movably coupled to the ice bucket body to open and close the outlet and provided to be manually pushed, and an elastic member which provides an elastic force in a direction opposite a direction the ice discharge button is pushed in.

In accordance with an aspect of the disclosure, a refrigerator may include a body, a door, a storage compartment formed by the body and the door, and an ice maker provided at the storage compartment. Here, the ice maker may include a supporting frame, at least one ice making tray in which water is stored and cooled to make ice, and a water pocket which stores water that is supplied to the at least one ice making tray which is mounted at a first position on the supporting frame, and is provided to be mounted on the supporting frame and rotate to a second position to pour the stored water, and a water supply guiding portion which guides the water poured from the water pocket to the at least one ice making tray.

In accordance with an aspect of the disclosure, a refrigerator may include a body, a door, a storage compartment formed by the body and the door, and an ice maker provided at the storage compartment. Here, the ice maker may include a plurality of ice making trays vertically arranged, a lever for separating ice of the plurality of ice making trays, and a link unit which connects the lever to the plurality of ice making trays to allow the plurality of ice making trays to respectively rotate about rotating shafts when the lever is operated. Also, at least one of the plurality of ice making trays rotates and linearly moves when the lever is operated.

In accordance with an aspect of the disclosure, a refrigerator may include a body, a door, a storage compartment formed by the body and the door, and an ice maker provided at the storage compartment. Here, the ice maker may include a plurality of ice making trays vertically arranged, a lever for separating ice of the plurality of ice making trays, a link unit which connects the lever to the plurality of ice making trays to allow the plurality of ice making trays to respectively rotate about rotating shafts when the lever is operated, and an ice holding preventing member which guides ice separated from at least one of the ice making trays so as not to be caught by another ice making tray.

In accordance with an embodiment of the disclosure, a refrigerator may include a body, a door, a storage compartment formed by the body and the door, and an ice maker provided at the storage compartment. Here, the ice maker may include an ice making tray which linearly moves with rotation while ice is separated, an ice bucket which stores ice separated from the ice making tray, and an ice guiding member which rotates to guide the ice separated from the ice making tray to the ice bucket by being interworked with the ice making tray.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
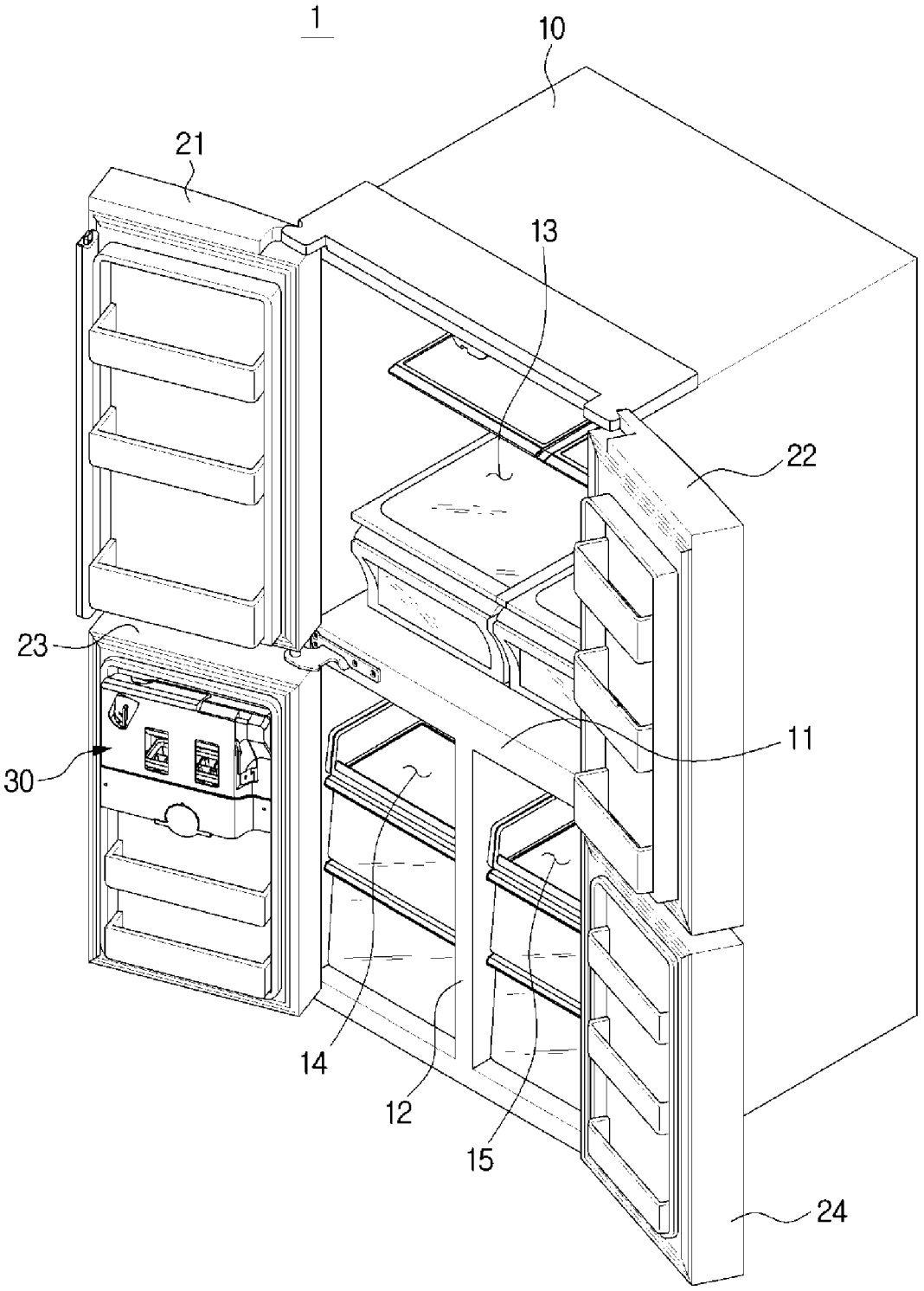
FIG. 1 is a view of a refrigerator including an ice maker according to a first embodiment of the disclosure.

Since embodiments disclosed herein are merely exemplary embodiments and do not represent all of the technical concepts of the disclosure, it should be appreciated that various equivalents or modifications that can replace the embodiments at the time of filing the application may be included in the scope of the disclosure.

Reference will now be made in detail to the embodiments, examples of which are illustrated in the accompanying drawings, wherein like reference numerals refer to like elements. Each of the drawings may be enlarged or slightly exaggerated to allow the disclosure to be easily understood.

It should be appreciated that unless otherwise defined, each term used herein including technical or scientific terms has the same meaning as that generally understood by one of ordinary skill in the art.

However, a term particularly designated herein will not be limited to a general or lexical meaning and should be understood as having a meaning and a concept appropriate for the technical concept of the disclosure based on the principle that it is possible to suitably define terms to describe the disclosure in the best way.

The terms first, second, etc. may be used to describe various components, but the components are not limited to the terms. That is, these terms are used only to distinguish one component from another.

Singular expressions, unless otherwise defined, may include plural expressions.

It should be understood that the terms "comprise," "have," etc. are used herein to specify the presence of stated components, features, numbers, steps, operations, or combinations thereof, but do not preclude the presence or addition of one or more other components, features, numbers, steps, operations, or combinations thereof.

When it is stated that a component is "in front of," "behind", "above," "below," "on the left side of," or "on the right side of" another component, in addition to meaning that the component is provided "in front of," "behind," "above," "below," "on the left side of," or "on the right side of" another component, a case in which still another component is disposed therebetween is also included.

Hereinafter, the exemplary embodiments of the disclosure will be described in detail with reference to the attached drawings.

Figure 2:
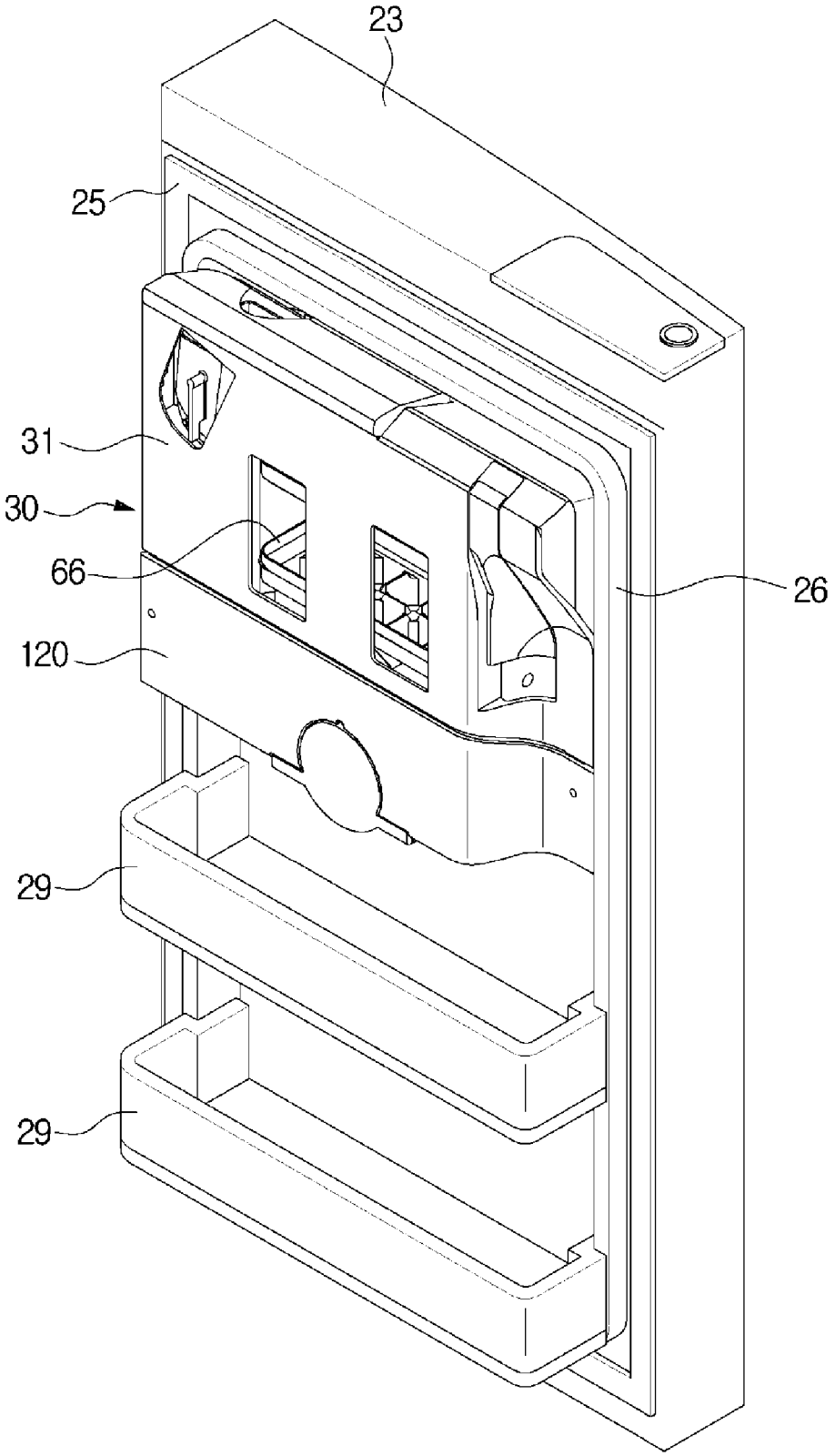
FIG. 2 is an enlarged view illustrating a state in which the ice maker according to the first embodiment of the disclosure is mounted on a door.
Figure 3:
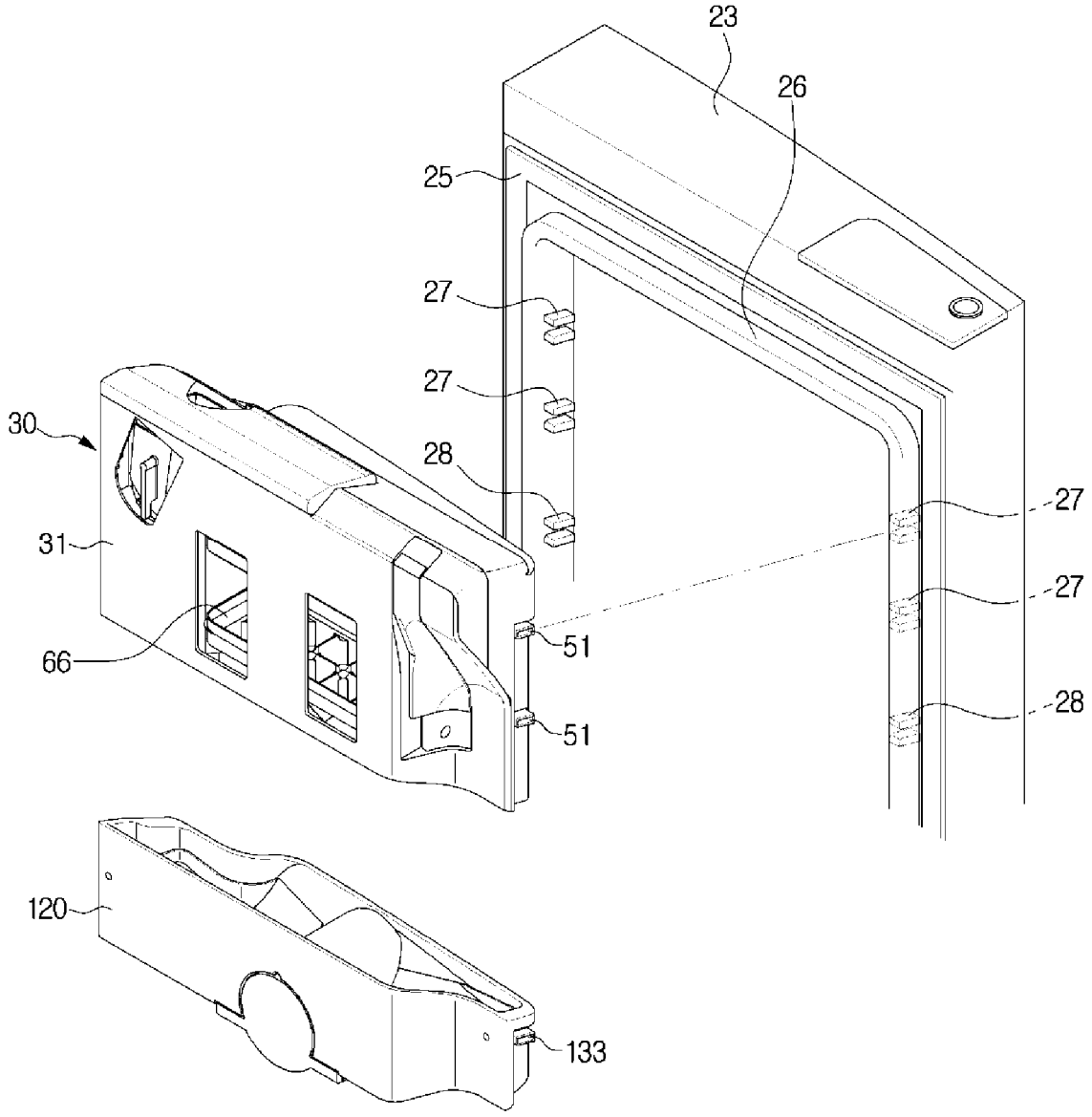
FIG. 3 is a view illustrating a state in which the ice maker according to the first embodiment of the disclosure is separated from the door.

FIG. 1 is a view of a refrigerator including an ice maker according to a first embodiment of the disclosure. FIG. 2 is an enlarged view illustrating a state in which the ice maker according to the first embodiment of the disclosure is mounted on a door. FIG. 3 is a view illustrating a state in which the ice maker according to the first embodiment of the disclosure is separated from the door.

Referring to FIGS. 1 to 3, a refrigerator 1 includes a body 10, doors 21, 22, 23, and 24, storage compartments 13, 14, and 15 formed by the body 10 and the doors 21, 22, 23, and 24, and a cool air supply device (not shown) which supplies cool air to the storage compartments 13, 14, and 15.

The body 10 may be box shaped and have an open front, and the doors 21, 22, 23, and 24 open and close the open front of the body 10. The storage compartments 13, 14, and 15 may be partitioned by a horizontal partition 11 and a vertical partition 12. An upper storage compartment 13 may be used as a refrigerating compartment, and lower storage compartments 14 and 15 may be used as freezing compartments.

The upper storage compartment 13 may be opened and closed by the doors 21 and 22, and a lower-left storage compartment 14 and a lower-right storage compartment 15 may be respectively opened and closed by the door 23 and the door 24. The doors 21, 22, 23, and 24 may be pivotably coupled to the body 10.

As described above, although the refrigerator according to the embodiment is a bottom mounted freezer (BMF) type refrigerator with four doors, the concept of the disclosure is not limited thereto. However, the refrigerator according to the embodiment may be applied to various types of refrigerator such as a top mounted freezer (TMF) type refrigerator, a side by side type refrigerator, a French door type refrigerator, a one-door type refrigerator, etc.

The cool air supply device may include a compressor, a condenser, an expansion valve, an evaporator, an air blowing fan, etc., may generate cool air through a cooling cycle, and may supply the cool air to the storage compartments.

An ice maker 30 which makes ice may be mounted on a rear side of the door 23. The ice maker 30 is separable from the rear side of the door 23. The ice maker 30 may be mounted on the rear side of the door 23, and may freeze water using cool air of the storage compartment 14 to make ice.

Also, the ice maker 30 may directly receive cooling energy from a refrigerant pipe (not shown) through which a refrigerant flows, and may make ice in a direct cooling method.

A gasket 25 for absorbing an impact caused by a collision with the body 10, which occurs when the door 23 is closed, and sealing a gap between the door 23 and the body 10 may be installed on the rear side of the door 23. The gasket 25 may be installed along an edge of the rear side of the door 23.

A dike 26 may protrude from an inside of the gasket 25, and the dike 26 may include dike mounting portions 27 and 28 capable of mounting a door guard 29 and the ice maker 30.

The ice maker 30 may include a supporting frame 31 on which ice making trays 61 and 66 are mounted and an ice bucket 120 which stores ice made at the ice making trays 61 and 66.

The ice making trays 61 and 66 may include at least one ice making cell which stores water, and the water stored in the ice making cell may be cooled to make ice.

The supporting frame 31 and the ice bucket 120 may be independently mounted on the rear side of the door 23. That is, the supporting frame 31 may be mounted on a first dike mounting portion 27, and the ice bucket 120 may be mounted on a second dike mounting portion 28.

The supporting frame 31 may include a mounting protrusion 51 to be mounted on the first dike mounting portion 27, and the ice bucket 120 may include a mounting protrusion 133 to be mounted on the second dike mounting portion 28. The dike mounting portions 27 and 28 may have grooved shapes such that the mounting protrusions 51 and 133 may be inserted in the grooved shapes of the dike mounting portions 27 and 28.

Figure 4:
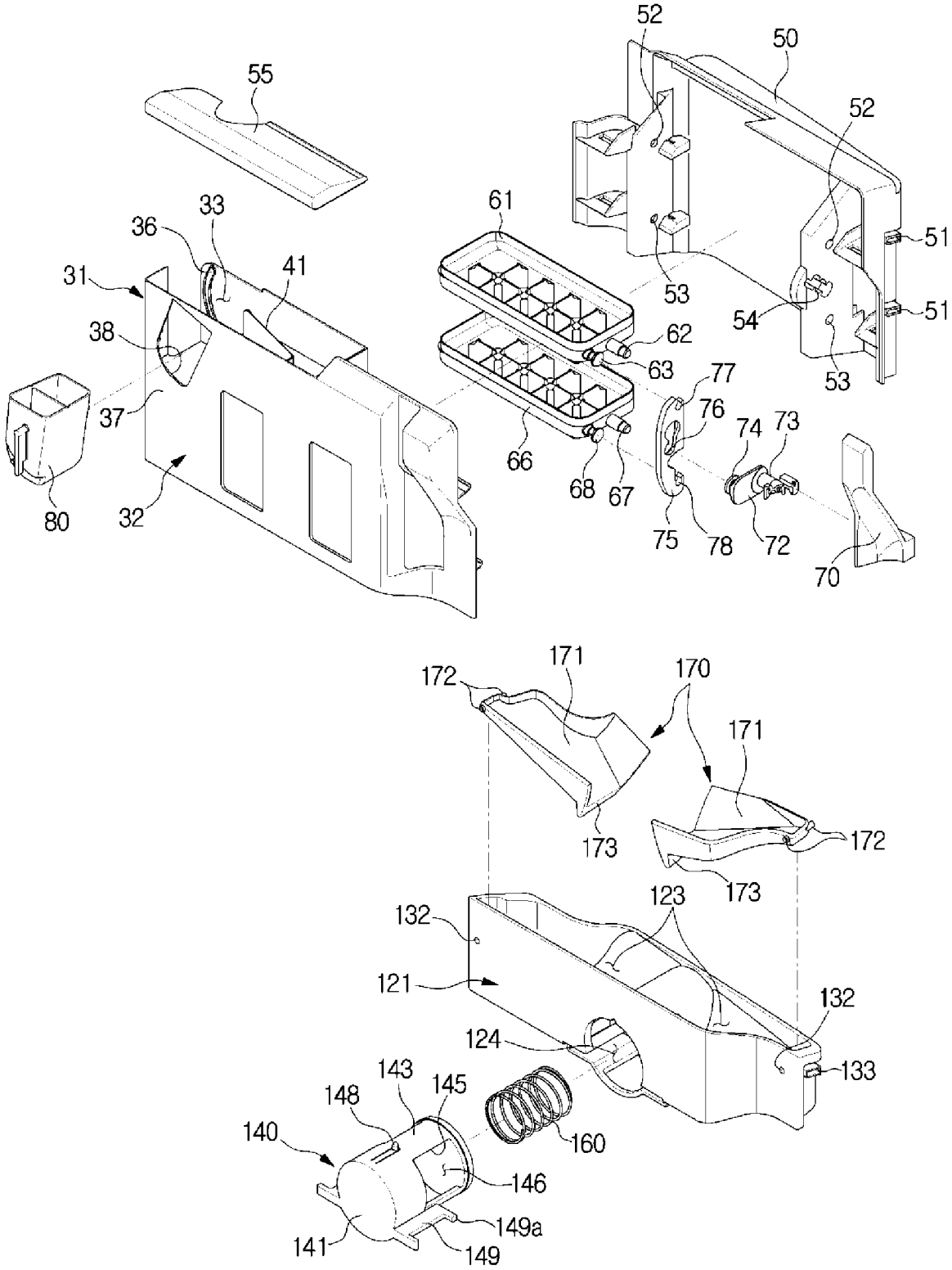
FIG. 4 is an exploded view of the ice maker according to the first embodiment of the disclosure.
Figure 5:
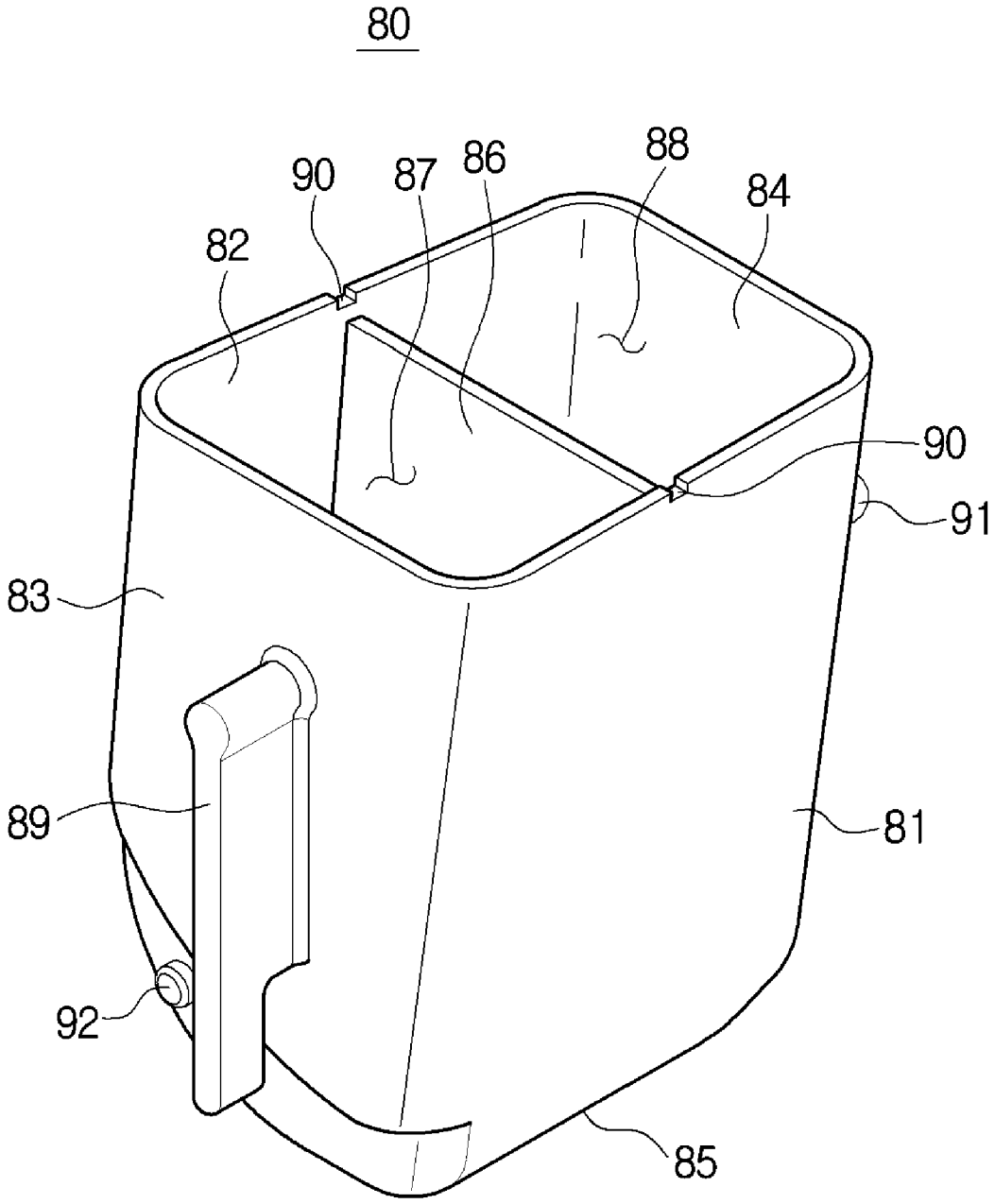
FIG. 5 is a view of a water pocket of the ice maker according to the first embodiment of the disclosure.
Figure 6:
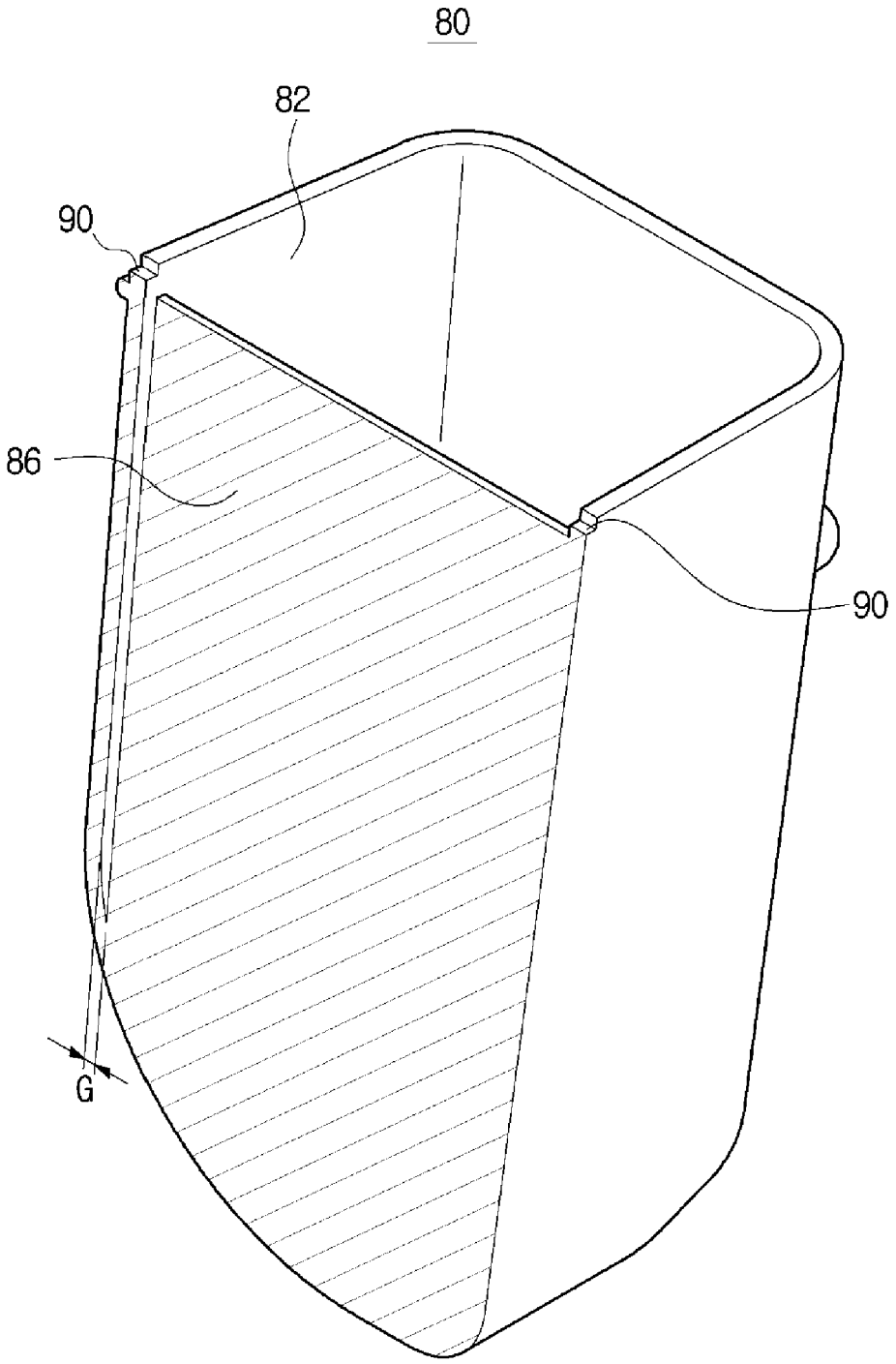
FIG. 6 is a cross-sectional view of the water pocket of the ice maker according to the first embodiment of the disclosure.
Figure 7:
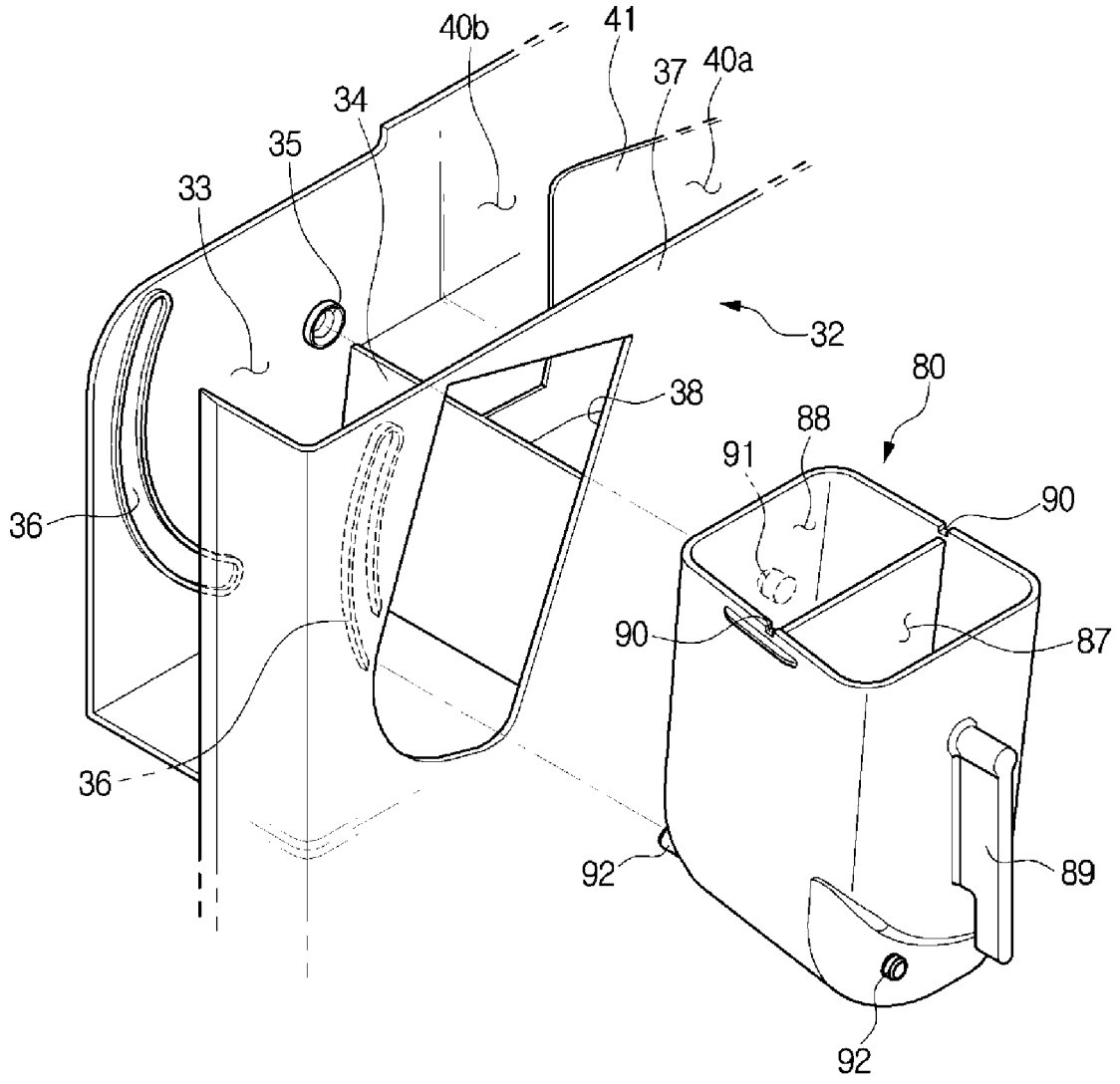
FIG. 7 is a view illustrating a state in which the water pocket of the ice maker according to the first embodiment of the disclosure is separated from a water pocket mounting portion.
Figure 8:
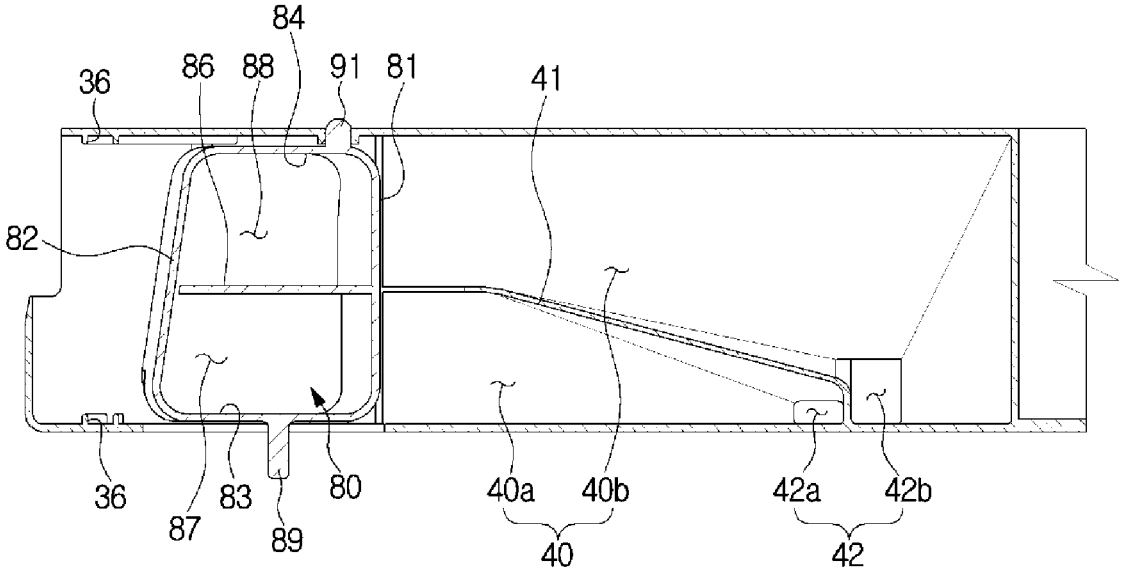
FIG. 8 is a plan cross-sectional view illustrating a state in which the water pocket of the ice maker according to the first embodiment of the disclosure is mounted on the water pocket mounting portion.
Figure 9:
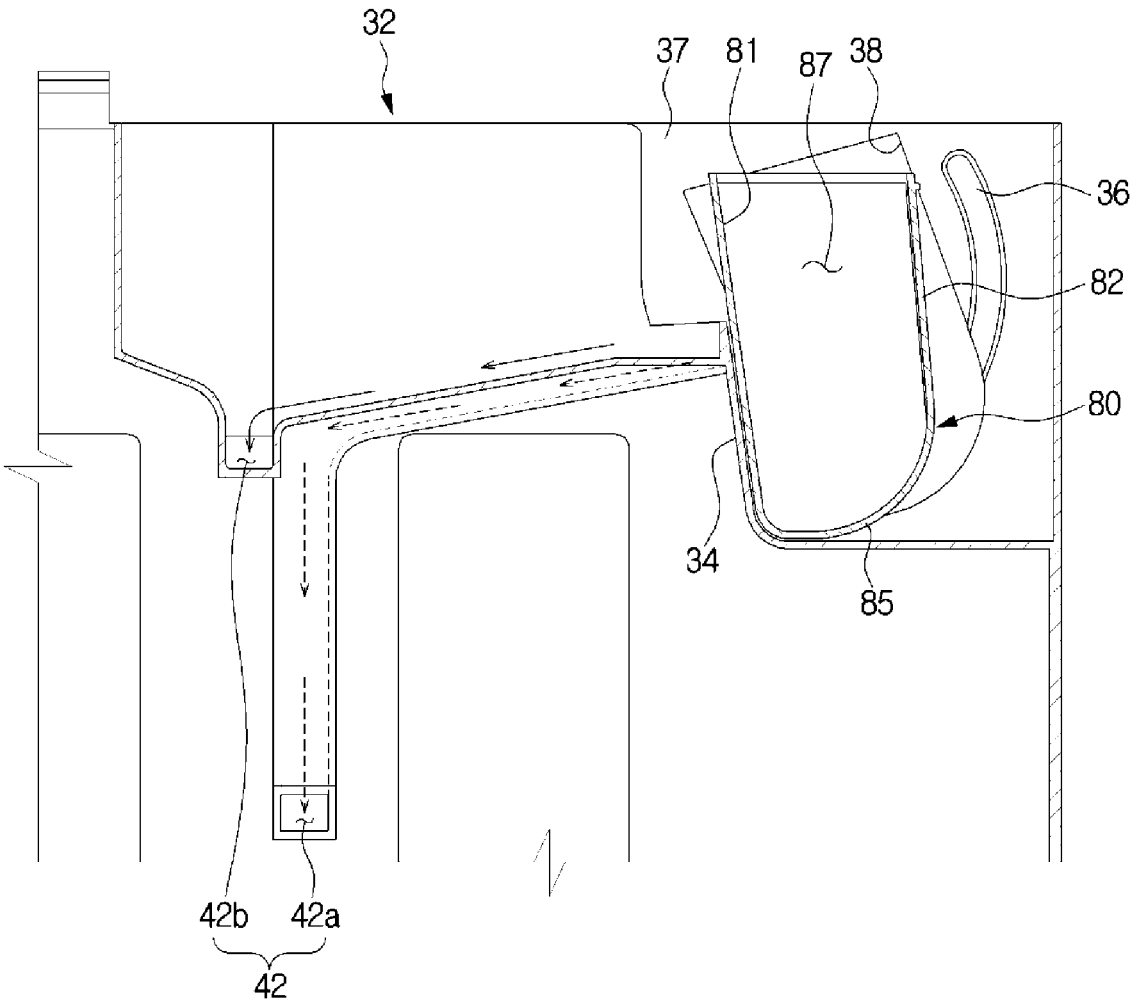
FIG. 9 is a cross-sectional view of a front frame of the ice maker according to the first embodiment of the disclosure which illustrates a channel portion guiding water of a drip tray to an ice making tray.
Figure 10:
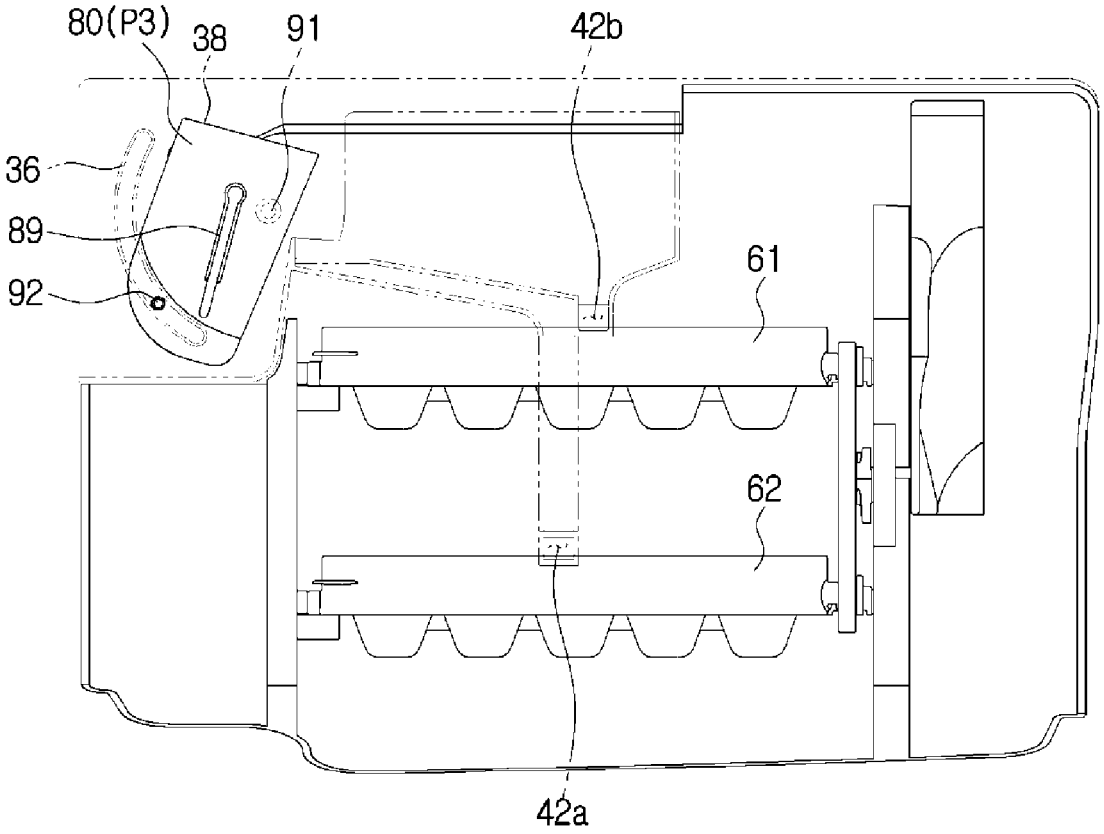
FIGS. 10 to 12 are views of a water supply structure of the ice maker according to the first embodiment of the disclosure.
Figure 11:
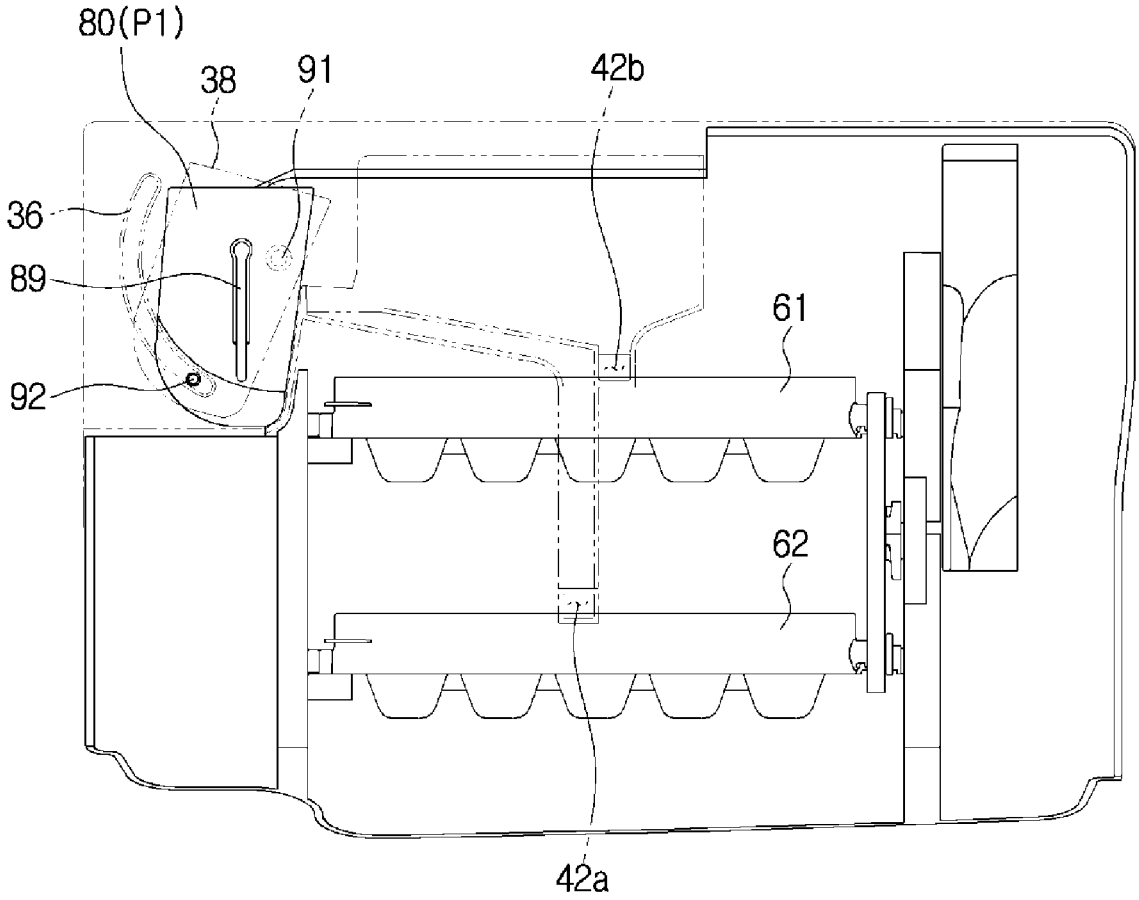
Figure 12:
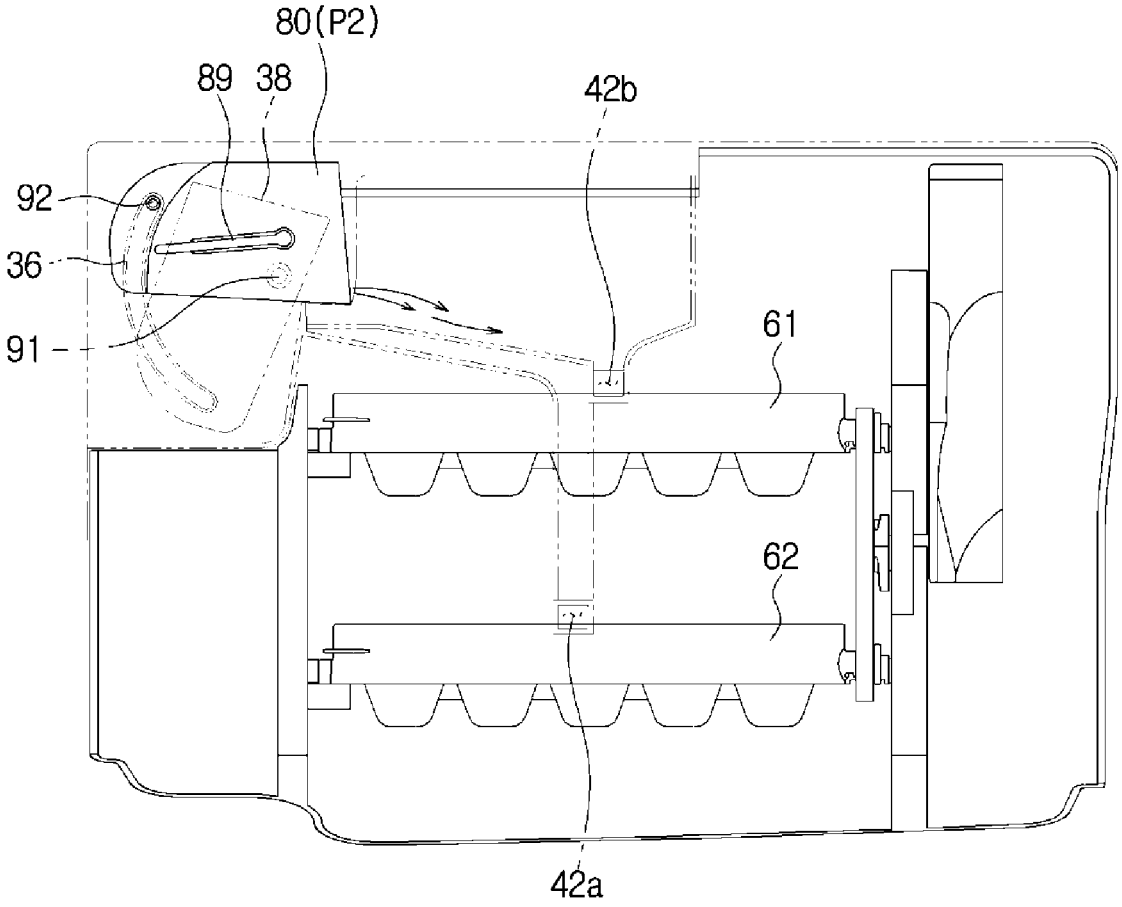

FIG. 4 is an exploded view of the ice maker according to the first embodiment of the disclosure. FIG. 5 is a view of a water pocket of the ice maker according to the first embodiment of the disclosure. FIG. 6 is a cross-sectional view of the water pocket of the ice maker according to the first embodiment of the disclosure. FIG. 7 is a view illustrating a state in which the water pocket of the ice maker according to the first embodiment of the disclosure is separated from a water pocket mounting portion. FIG. 8 is a plan cross-sectional view illustrating a state in which the water pocket of the ice maker according to the first embodiment of the disclosure is mounted on the water pocket mounting portion. FIG. 9 is a cross-sectional view of a front frame of the ice maker according to the first embodiment of the disclosure which illustrates a channel portion guiding water at a drip tray to the ice making tray. FIGS. 10 to 12 are views of a water supply structure of the ice maker according to the first embodiment of the disclosure.

A detailed configuration and the water supply structure of the ice maker according to the first embodiment of the disclosure will be described in detail with reference to FIGS. 4 to 12.

The ice maker 30 may include one or more ice making trays 61 and 66 which store water and cool the water to make ice, a water pocket 80 which stores water to be supplied to the one or more ice making trays 61 and 66, the supporting frame 31 which supports the ice making trays 61 and 66 and the water pocket 80, and the ice bucket 120 provided to store ice separated from the ice making trays 61 and 66.

Although the ice maker 30 includes a plurality of such ice making trays 61 and 66 in the embodiment, the concept of the disclosure is not limited thereto and only one ice making tray may be included.

A plurality of ice making trays 61 and 66 may be vertically arranged. The ice making trays 61 and 66 may include a plurality of ice making cells which store water. The ice making trays 61 and 66 may be provided to be rotatable to separate the ice from the ice making trays 61 and 66.

For this, the ice making trays 61 and 66 may include rotating shafts 62 and 67. The rotating shafts 62 and 67 may protrude in longitudinal directions of the ice making trays 61 and 66. The rotating shafts 62 and 67 may be rotatably inserted in rotating shaft accommodating grooves 52 and 53 of the supporting frame 31.

The ice making trays 61 and 66 may respectively include connecting pins 63 and 68 connected to a connecting member 75 which will be described below. The connecting pins 63 and 68 may be provided to be respectively spaced apart from the rotating shafts 62 and 67 by certain distances. Accordingly, when torque is applied to the connecting pins 63 and 68 by the connecting member 75, the ice making trays 61 and 66 may respectively rotate around the rotating shafts 62 and 67.

The ice maker 30 may include a lever 70 which rotates the ice making trays 61 and 66 to separate the ice made in the ice making trays 61 and 66. The ice maker 30 may be provided to move the plurality of ice making trays 61 and 66 by rotating the one lever 70.

For this, the ice maker 30 may include a link unit which transfers torque applied to the lever 70 to the plurality of ice making trays 61 and 66. The link unit may include a link shaft 72 and the connecting member 75.

The link shaft 72 may include a handle coupling portion coupled to the lever 70, a first shaft portion 73 rotatably inserted in a link shaft accommodating groove 54 of the supporting frame 31, a second shaft portion 74 which rotates and is eccentric with the first shaft portion 73, and an extending portion which connects the first shaft portion 73 with the second shaft portion 74.

The connecting member 75 connects the link shaft 72 with the plurality of ice making trays 61 and 66. The connecting member 75 may include a second shaft portion insertion groove 76 in which the second shaft portion 74 of the link shaft 72 is inserted, a first connecting pin insertion groove 77 in which a first connecting pin 63 of a first ice making tray 61 is inserted, and a second connecting pin insertion groove 78 in which a second connecting pin 68 of a second ice making tray 66 is inserted.

When the lever 70 is rotated using these components, the second shaft portion 74 of the link shaft 72 rotates around the first shaft portion 73, the connecting member 75 rotates as the second shaft portion 74 rotates, and the plurality of ice making trays 61 and 66 rotate together as the connecting member 75 rotates.

The water pocket 80 is for precisely supplying a required amount of water to the ice making trays 61 and 66. The water pocket 80 may store water to be supplied to the ice making trays 61 and 66 and may be mounted on a water pocket mounting portion 33, which will be described below, while storing water. The water pocket mounting portion 33 may be formed at the supporting frame 31. The water pocket 80 may include markings which indicate an amount of water contained in the water pocket 80.

The water pocket 80 may have a cup shape with an open top side. That is, the water pocket 80 may include a front wall 81, a rear wall 82, a left wall 83, a right wall 84, and a bottom 85, and may have the open top side. The water pocket 80 may include water storage spaces 87 and 88 for storing water therein. Water may flow in and out of the water storage spaces 87 and 88 through the open top side of the water pocket 80.

That is, it is possible to put water into the water pocket 80 when the water pocket 80 is in a position at which the open top side of the water pocket 80 faces upward (hereinafter, referred to as a regular position) and water stored in the water pocket 80 may flow outward when the water pocket 80 is in a position at which the water pocket 80 lies down to allow the open top side to face sideways (hereinafter, referred to as a lying position).

The water storage spaces 87 and 88 may be divided into a first water storage space 87 and a second water storage space 88 to supply required amounts of water to the plurality of ice making trays 61 and 66. The first water storage space 87 and the second water storage space 88 may be divided by an intermediate wall 86.

However, when water is put into any one of the first water storage space 87 and the second water storage space 88, a gap G (refer to FIG. 6) may be formed between the intermediate wall 86 and the rear wall 82 to allow the water to flow into the other water storage space. The gap G may be formed from a top end to a bottom of the water pocket 80.

Accordingly, when water is supplied to any one of the first water storage space 87 and the second water storage space 88 while the water pocket 80 is in the regular position, the water may flow into the other water storage space through the gap G in such a way that the first water storage space 87 and the second water storage space 88 may be filled with the same level of water.

When the water pocket 80 is in the lying position, the gap G is moved upward. Accordingly, the water in the first water storage space 87 and the water in the second water storage space 88 may not be mixed with each other and required amounts thereof may be supplied to the ice making trays 61 and 66, respectively.

The water pocket 80 may be mounted on the water pocket mounting portion 33 after being filled with water while in the regular position and may rotate to the lying position by a manual operation.

The water pocket 80 may include a handle 89 to be rotated by hand, a rotating pin 91 which rotatably supports the water pocket 80 and is a rotational center thereof, and a rotating protrusion 92 which guides rotation.

The supporting frame 31 may include a rotating pin accommodating portion 35 (refer to FIG. 7) which accommodates the rotating pin 91 of the water pocket 80 and a rotation guide groove 36 which guides rotation of the rotating protrusion 92 of the water pocket 80.

The supporting frame 31 may support the ice making trays 61 and 66 and the water pocket 80. The supporting frame 31 may include a front frame 32, a rear frame 50, and an upper frame 55. The front frame 32 may be positioned in front of the ice making trays 61 and 66. The rear frame 50 may be positioned behind the ice making trays 61 and 66. The upper frame 55 may be positioned above the ice making trays 61 and 66.

The front frame 32, the rear frame 50, and the upper frame 55 may be separately provided and mutually assembled. However, unlike the embodiment, the front frame 32, the rear frame 50, and the upper frame 55 may be integrated with one another.

The rear frame 50 may include a mounting protrusion 51 for being mounted on a rear side of a door. Also, the rear frame 50 may include the rotating shaft accommodating grooves 52 and 53 in which the rotating shafts 62 and 67 of the ice making trays 61 and 66 are rotatably inserted, and the link shaft accommodating groove 54 in which the first shaft portion 73 of the link shaft 72 is rotatably inserted.

The front frame 32 may have the water pocket mounting portion 33 on which the water pocket 80 is mounted. The water pocket 80 may be mounted in the regular position on the water pocket mounting portion 33 and then may rotate due to a manual operation.

The front frame 32 may include a water pocket supporting portion 34 (refer to FIGS. 7 and 9) which supports the water pocket 80 to maintain the water pocket 80 mounted on the water pocket mounting portion 33 in the regular position.

The front frame 32 may have a sidewall supporting portion 37 which supports the left wall 83 of the water pocket 80. The sidewall supporting portion 37 may include a water pocket through hole 38 provided to allow the water pocket 80 to pass therethrough. The water pocket 80 may pass through the water pocket through hole 38 and may enter the water pocket mounting portion 33. That is, the water pocket 80 may horizontally enter the water pocket mounting portion 33 to be mounted thereon.

The water pocket through hole 38 may have a shape that corresponds to a shape of the water pocket 80 but is slightly tilted. Accordingly, the water pocket 80 may pass through the water pocket through hole 38 from a regular position P1 (refer to FIG. 11) to a slightly tilted position P3 (refer to FIG. 10). The water pocket 80 which passes through the water pocket through hole 38 pivots to the regular position P1 due to its own weight, and accordingly the water pocket 80 which passes through the water pocket through hole 38 may not leave the water pocket through hole 38.

The water pocket 80 which pivots to the regular position P1 is maintained at the regular position P1 by the water pocket supporting portion 34, and pivots to a lying position P2 (refer to FIG. 12) by a manual operation of a user to discharge stored water.

The supporting frame 31 may include a water supply guiding portion which guides water poured from the water pocket 80 to the ice making trays 61 and 66.

The water supply guiding portion may include a drip tray 40 which receives water poured from the water pocket 80, and a channel portion 42 which guides water of the drip tray 40 to the ice making trays 61 and 66.

The drip tray 40 may be formed in a plate shape to stably collect the water poured from the water pocket 80. The drip tray 40 may be divided into a plurality of troughs 40*a* and 40*b* to respectively receive the water poured from a plurality of such water storage spaces 87 and 88 of the water pocket 80. The plurality of troughs 40*a* and 40*b* may be partitioned into independent spaces by a partitioning rib 41.

The water pocket 80 may include a partitioning rib insertion groove 90 in which the partitioning rib 41 is inserted to supply water in the first water storage space 87 and water in the second water storage space 88 to a first trough 40*a* and a second trough 40*b*, respectively, without mixing the water while pivoting to the lying position.

The channel portion 42 may be formed in a path shape to guide the water of the drip tray 40 to the ice making trays 61 and 66 without leaking the water. The channel portion 42 may include a first channel 42*a* connected to the first trough 40*a* and a second channel 42*b* connected to the second trough 40*b*.

Due to the configuration described above, it is possible to easily supply a required amount of water to the ice making trays 61 and 66. The required amount of water may be easily supplied to each of the ice making trays 61 and 66 even when the plurality of ice making trays 61 and 66 are provided.

Figure 13:
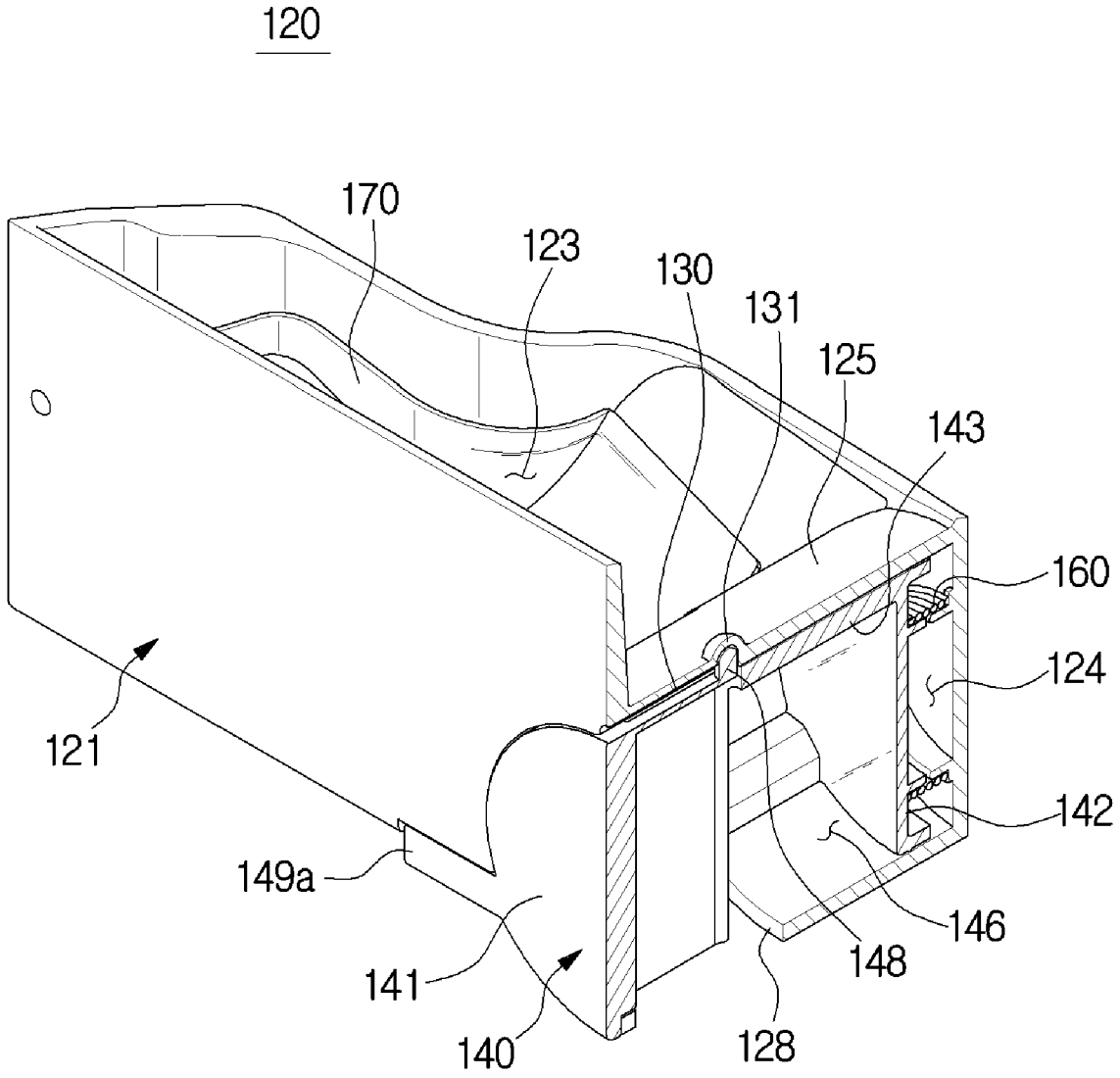
FIG. 13 is a side cross-sectional view illustrating a state in which an ice discharge button of an ice bucket of the ice maker according to the first embodiment of the disclosure is closed.
Figure 14:
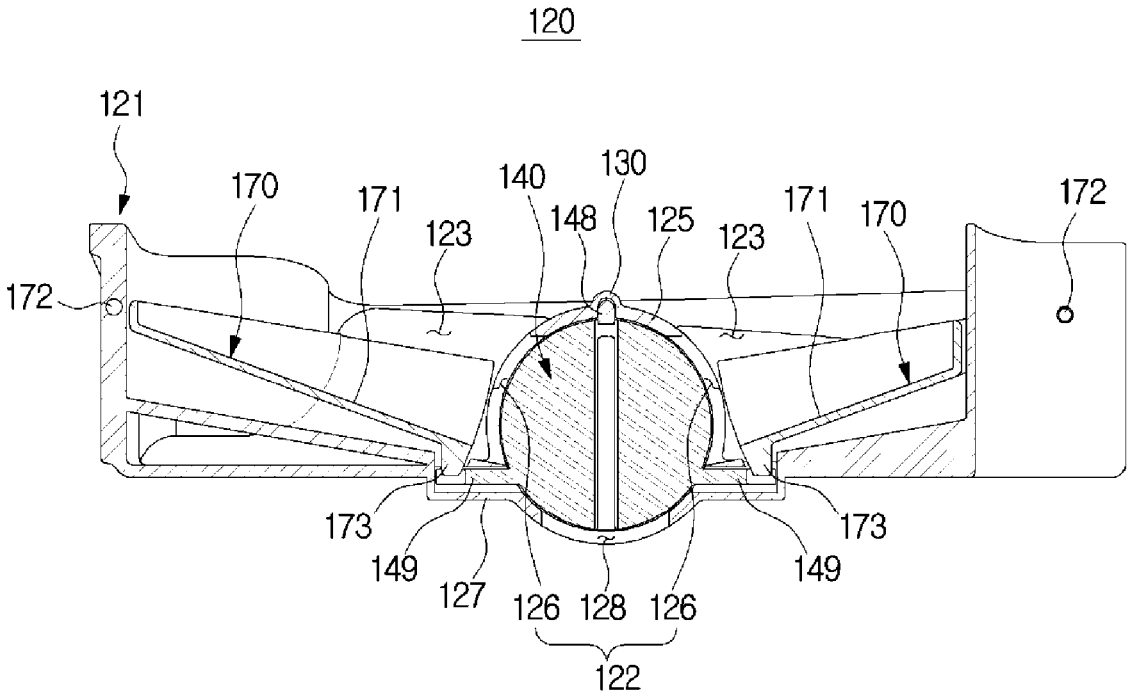
FIG. 14 is a front cross-sectional view illustrating a state in which the ice discharge button of the ice bucket of the ice maker according to the first embodiment of the disclosure is closed.
Figure 15:
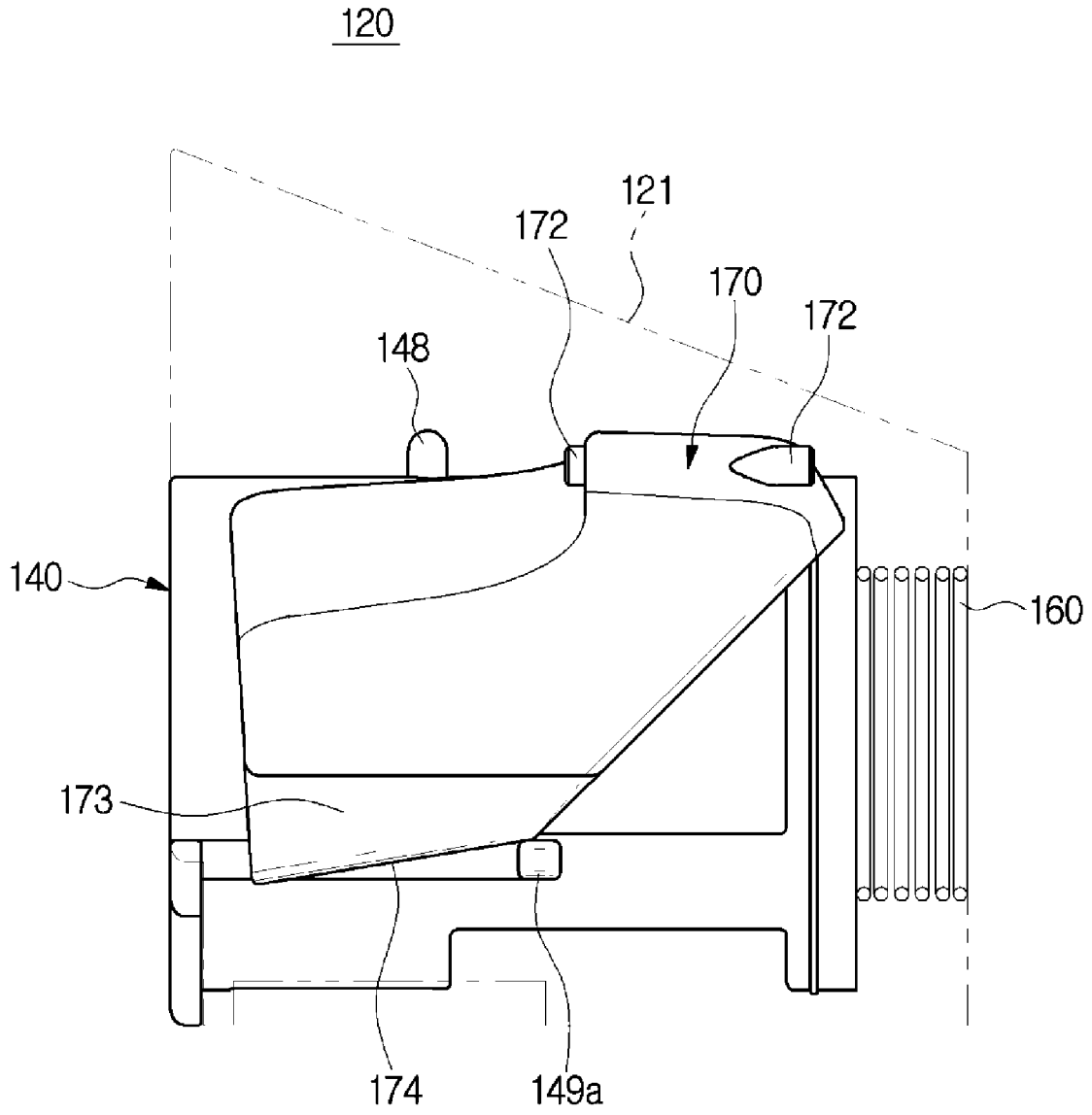
FIG. 15 is a side view illustrating a state in which the ice discharge button of the ice bucket of the ice maker according to the first embodiment of the disclosure is closed.
Figure 16:
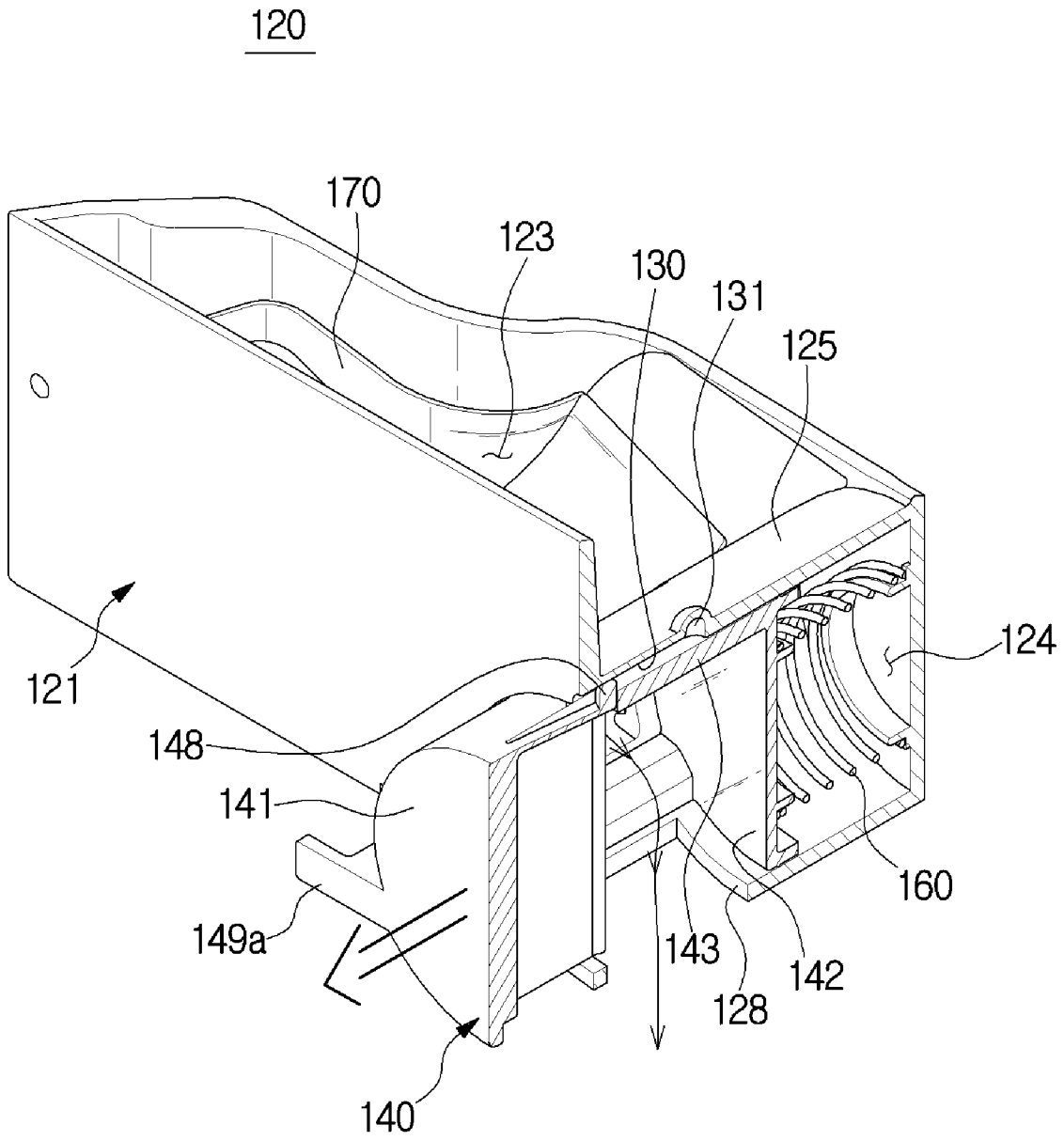
FIG. 16 is a side cross-sectional view illustrating a state in which the ice discharge button of the ice bucket of the ice maker according to the first embodiment of the disclosure is opened.
Figure 17:
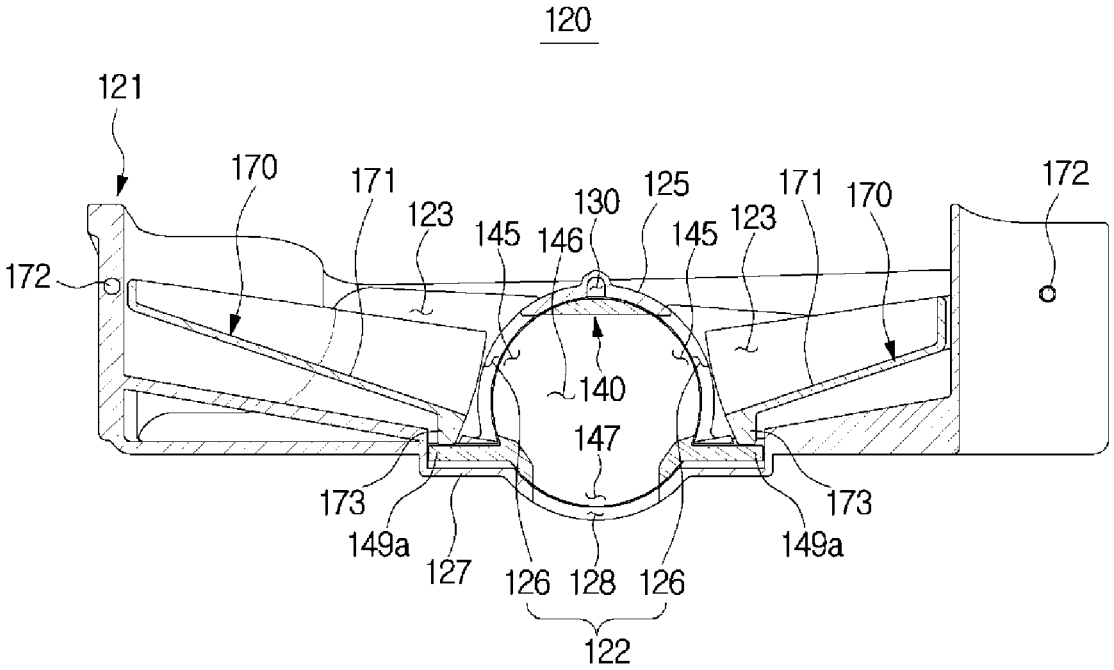
FIG. 17 is a front cross-sectional view illustrating a state in which the ice discharge button of the ice bucket of the ice maker according to the first embodiment of the disclosure is opened.
Figure 18:
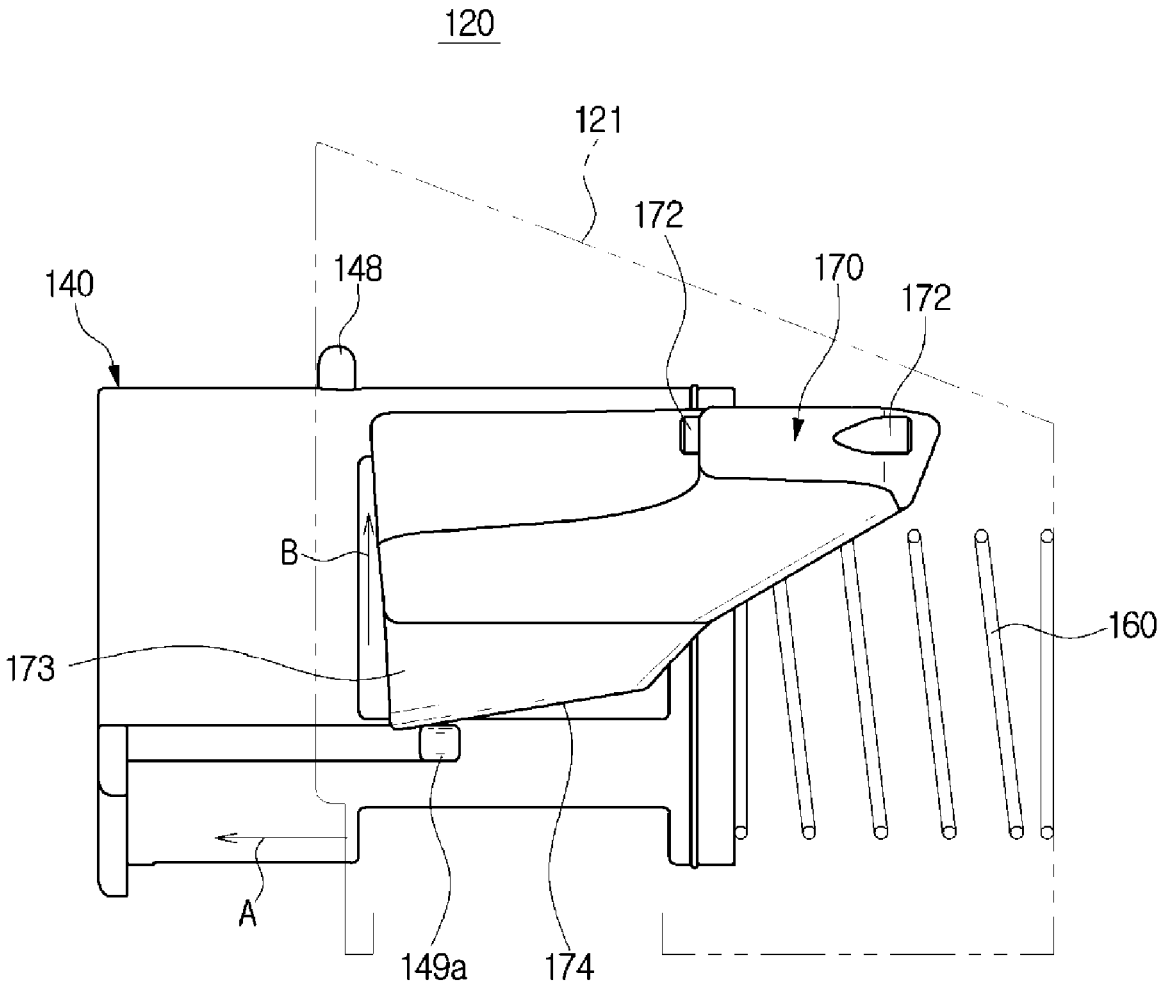
FIG. 18 is a side view illustrating a state in which the ice discharge button of the ice bucket of the ice maker according to the first embodiment of the disclosure is opened.

FIG. 13 is a side cross-sectional view illustrating a state in which an ice discharge button of the ice bucket of the ice maker according to the first embodiment of the disclosure is closed. FIG. 14 is a front cross-sectional view illustrating a state in which the ice discharge button of the ice bucket of the ice maker according to the first embodiment of the disclosure is closed. FIG. 15 is a side view illustrating a state in which the ice discharge button of the ice bucket of the ice maker according to the first embodiment of the disclosure is closed. FIG. 16 is a side cross-sectional view illustrating a state in which the ice discharge button of the ice bucket of the ice maker according to the first embodiment of the disclosure is opened. FIG. 17 is a front cross-sectional view illustrating a state in which the ice discharge button of the ice bucket of the ice maker according to the first embodiment of the disclosure is opened. FIG. 18 is a side view illustrating a state in which the ice discharge button of the ice bucket of the ice maker according to the first embodiment of the disclosure is opened.

A configuration of an ice dispensing structure of the ice bucket of the ice maker according to the first embodiment of the disclosure will be described with reference to FIGS. 4 and 13 to 18.

The ice maker 30 includes the ice bucket 120 which stores ice separated from the ice making trays 61 and 66.

The ice bucket 120 includes an ice bucket body 121, an ice discharge button 140 provided to dispense ice stored in the ice bucket body 121, and an elastic member 160 which elastically supports the ice discharge button 140.

The ice bucket body 121 is configured to have a container shape with an open top side, and is disposed below the ice making trays 61 and 66. Accordingly, ice which is separated from the ice making trays 61 and 66 to freely fall may enter the ice bucket body 121.

Since a conventional general ice bucket body does not include a separate ice outlet, the whole ice bucket body 121 is separated to withdraw the ice through the open top side of the ice bucket body 121 when withdrawing the ice stored in the ice bucket body 121.

The ice bucket body 121 according to the embodiment of the disclosure includes an outlet 122 for discharging ice. Accordingly, it is unnecessary to separate the whole ice bucket body 121 from the door when withdrawing ice from the ice bucket body 121, and it is possible to discharge ice downward from the outlet 122 by opening the outlet 122 while the ice bucket body 121 is mounted on the door.

The ice bucket body 121 includes an ice storage portion 123, which stores ice, and an ice discharge button accommodating portion 124, which guides and accommodates the ice discharge button 140. In the embodiment, the ice discharge button accommodating portion 124 is positioned at the center, and the ice storage portions 123 are positioned on both sides of the ice discharge button accommodating portion 124, but the embodiment is not limited thereto and at least one ice storage portion 123 and ice discharge button accommodating portion 124 would be satisfactory.

The ice bucket body 121 includes a partition wall 125 which partitions the ice storage portion 123 and the ice discharge button accommodating portion 124. In the embodiment, the partition wall 125 is configured to have a cylindrical shape, but the shape of the partition wall 125 is not limited thereto.

The outlet 122 includes a first outlet 126 formed at the partition wall 125 and a second outlet 128 formed at a bottom 127 of the ice bucket body 121.

A plurality of such first outlets 126 may be formed corresponding to a plurality of such ice storage portions 123. The first outlet 126 connects the ice storage portion 123 with the ice discharge button accommodating portion 124 to discharge ice of the ice storage portion 123 into the ice discharge button accommodating portion 124.

The second outlet 128 discharges the ice in the ice discharge button accommodating portion 124 below the ice bucket body 121.

The ice discharge button 140 may be configured to have an approximately cylindrical shape corresponding to the shape of the ice discharge button accommodating portion 124, and a hollow 146. The ice discharge button 140 is movable such that it may be inserted into or withdrawn from the ice discharge button accommodating portion 124.

In the embodiment, the ice discharge button 140 is configured to be horizontally movable but is not limited thereto, and may be configured to be vertically movable.

The ice discharge button 140 may include a push portion 141 provided to be manually pushed, and an elastic member supporting portion 142 provided opposite the push portion 141.

A first through hole 145 and a second through hole 147 may be formed at a circumferential portion 143 of the ice discharge button 140. The first through hole 145 is provided to correspond to the first outlet 126 of the ice bucket body 121, and the second through hole 147 is provided to correspond to the second outlet 128 of the ice bucket body 121.

As shown in FIGS. 13 to 15, the ice discharge button 140 may be configured to block the first outlet 126 and the second outlet 128 when the ice discharge button 140 is inserted into the ice discharge button accommodating portion 124.

The ice discharge button 140 may be inserted into the ice discharge button accommodating portion 124 by manually pushing the push portion 141.

As shown in FIGS. 16 to 18, the ice discharge button 140 may be configured to open the first outlet 126 and the second outlet 128 to discharge ice stored in the ice bucket body 121 when the ice discharge button 140 is withdrawn from the ice discharge button accommodating portion 124.

Here, the first through hole 145 of the ice discharge button 140 faces the first outlet 126 of the ice bucket body 121, and the second through hole 147 of the ice discharge button 140 faces the second outlet 128 of the ice bucket body 121.

The ice of the ice storage portion 123 may be discharged outward through the first outlet 126, the first through hole 145, the hollow 146, the second through hole 147, and the second outlet 128.

The ice discharge button 140 may be withdrawn outward from the ice discharge button accommodating portion 124 by an elastic force of the elastic member 160.

That is, the elastic member 160 accumulates an elastic force when the user pushes the push portion 141 to insert the ice discharge button 140 into the ice discharge button accommodating portion 124, and applies the elastic force in a direction opposite to a direction the ice discharge button 140 is pushed in to push the ice discharge button 140 outward from the ice discharge button accommodating portion 124 when the user takes his or her hand from the push portion 141.

The ice discharge button 140 may include an elastic holding protrusion 148 configured to be held in a closed state by the ice bucket body 121. When the elastic holding protrusion 148 is held by the ice bucket body 121, the ice discharge button 140 may be maintained in the closed state despite the elastic force of the elastic member 160.

The elastic holding protrusion 148 may protrude from the circumferential portion 143 of the ice discharge button 140 to be elastically modifiable.

The ice bucket body 121 includes an elastic holding protrusion path 130 which guides movement of the elastic holding protrusion 148, and an elastic holding groove 131 which holds the elastic holding protrusion 148.

The elastic holding protrusion path 130 may be formed at an inner circumferential surface of the partition wall 125 at a certain depth along an insertion and withdrawal direction of the ice discharge button 140. The elastic holding groove 131 may be formed to be deeper than the elastic holding protrusion path 130 at an end of the elastic holding protrusion path 130.

The ice bucket 120 may further include an oscillating member 170 which applies oscillation to ice stored in the ice bucket body 121. The oscillating member 170 may apply oscillation to the ice to remove binding of the ice to allow the ice to be easily discharged through the outlet 122.

The oscillating member 170 may be provided to be moved by being interconnected with the ice discharge button 140. A plurality of such oscillating members 170 may be provided to be disposed at the ice storage portions 123 on both sides.

The oscillating member 170 may include an ice supporting portion 171 which supports ice, a fixed end portion 172 coupled to the ice bucket body 121, and an operating end portion 173 provided to rotate about the fixed end portion 172 at the opposite side of the fixed end portion 172.

The ice bucket body 121 may include a fixed end portion insertion groove 132 into which the fixed end portion 172 is inserted.

The ice discharge button 140 includes an interconnecting portion 149 which protrudes to move the oscillating member 170 by interconnecting it with movement of the discharge button 140. The interconnecting portion 149 includes an interconnecting protrusion **149*a* provided to be in contact with the operating end portion 173 of the oscillating member 170**.

The operating end portion 173 includes an inclined portion 174 which interacts with the interconnecting protrusion **149*a* to allow the operating end portion 173 to vertically move according to the movement of the ice discharge button 140**.

As shown in FIGS. 15 and 18, when the ice discharge button 140 is withdrawn in a direction A, the interconnecting protrusion **149*a* moves from back to front along the inclined portion 174 and lifts the operating end portion 173 in a direction B. On the contrary, when the ice discharge button 140 is inserted, the interconnecting protrusion 149*a* moves from front to back along the inclined portion 174 and the operating end portion 173 of the oscillating member 170** moves downward.

As described above, as the operating end portion 173 of the oscillating member 170 moves upward and downward, the ice supported by the ice supporting portion 171 may receive oscillation, and binding of the ice may be reduced.

Figure 19:
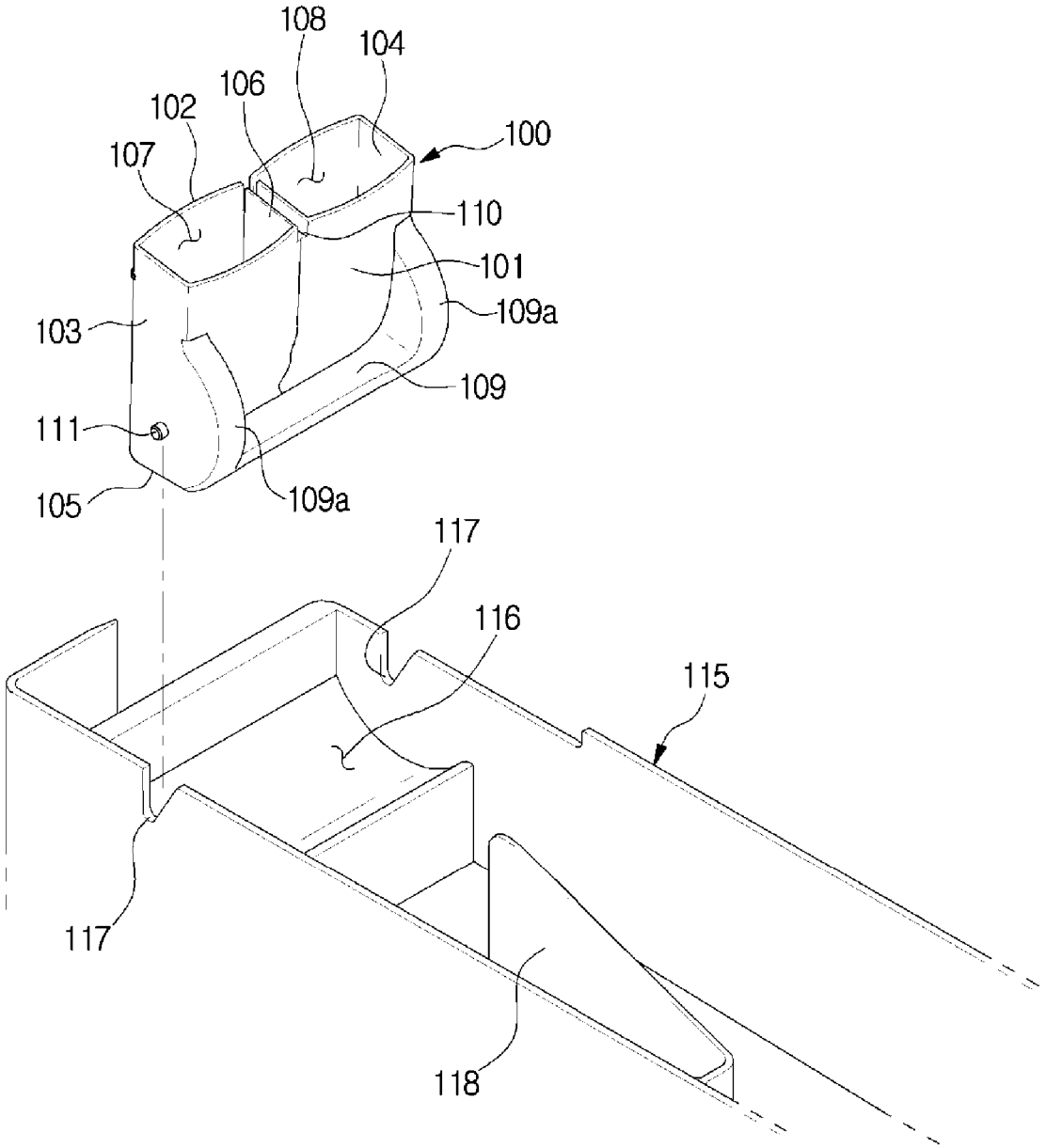
FIG. 19 is a configuration diagram illustrating a water pocket and a water pocket mounting portion of an ice maker according to a second embodiment of the disclosure.
Figure 20:
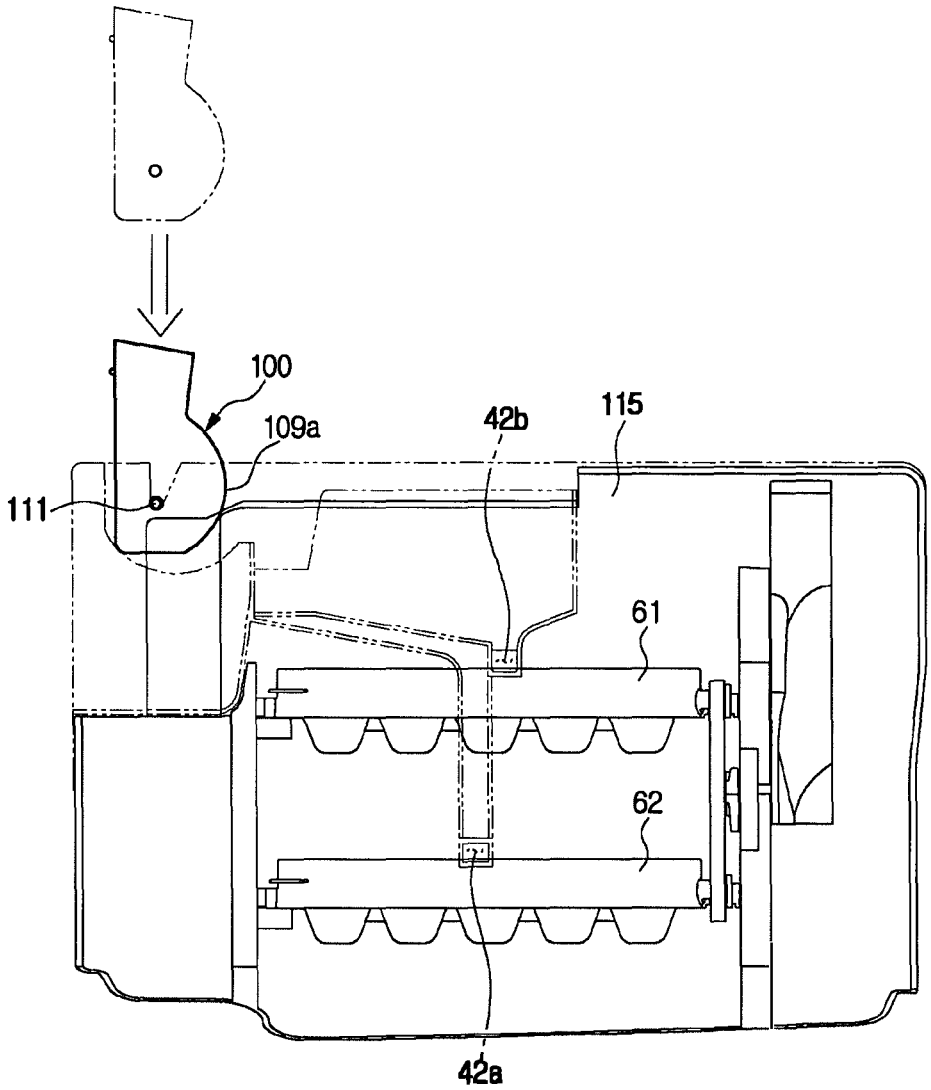
FIGS. 20 and 21 are views of a water supply structure of the ice maker according to the second embodiment of the disclosure.
Figure 21:
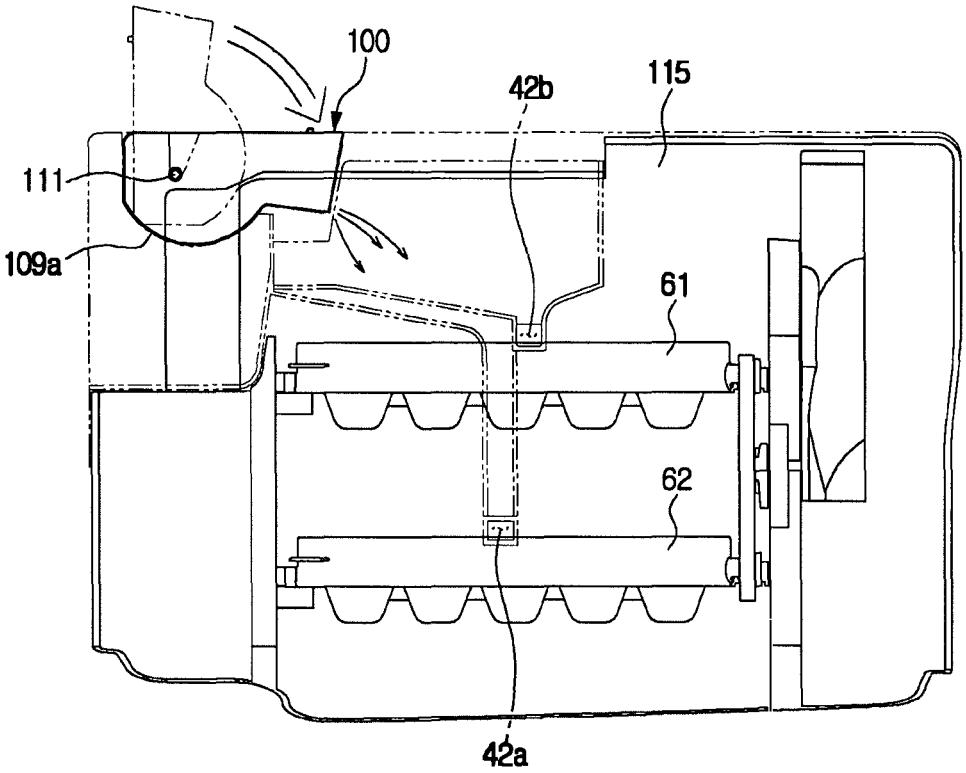

FIG. 19 is a configuration diagram illustrating a water pocket and a water pocket mounting portion of an ice maker according to a second embodiment of the disclosure. FIGS. 20 and 21 are views of a water supply structure of the ice maker according to the second embodiment of the disclosure.

The ice maker according to the second embodiment of the disclosure will be described with reference to FIGS. 19 to 21. Like reference numerals refer to like elements as in the first embodiment, and descriptions thereof will be omitted.

Unlike the first embodiment, a water pocket 100 may be configured to be mounted on a water pocket mounting portion 116 and then to autonomously rotate to a lying position. Also, unlike to the first embodiment, the water pocket 100 may be mounted on the water pocket mounting portion 116 from top to bottom.

That is, when the water pocket 100 is filled with water and is mounted on the water pocket mounting portion 116 of a supporting frame 115 from top to bottom as shown in FIG. 20, the water pocket 100 autonomously rotates to the lying position, and then water in the water pocket 100 is poured and supplied to ice making trays 61 and 62 as shown in FIG. 21.

The water pocket 100 may have a cup shape with an open top side. That is, the water pocket 100 may include a front wall 101, a rear wall 102, a left wall 103, a right wall 104, and a bottom 105, and may have the open top side. The water pocket 100 may include water storage spaces 107 and 108 for storing water therein. Water may flow in and out of the water storage spaces 107 and 108 through the open top side of the water pocket 100.

The water storage spaces 107 and 108 may be divided into a first water storage space 107 and a second water storage space 108 to supply required amounts of water to a plurality of such ice making trays 61 and 62, respectively. The first water storage space 107 and the second water storage space 108 may be mutually divided by an intermediate wall 106.

The water pocket 100 further includes a protruding portion 109 which protrudes from the front wall 101, and the protruding portion 109 includes a round portion 109*a* formed to be round. When mounted on the water pocket mounting portion 116, the water pocket 100 may autonomously rotate due to a weight of the protruding portion 109 and a shape of the round portion 109*a*.

The water pocket 100 may include a rotating pin 111 which is a rotation center and is provided at the left wall 103 and the right wall 104, and the supporting frame 115 may include a rotating pin accommodating portion 117 in which the rotating pin 111 is inserted.

The supporting frame 115 may include a water supply guiding portion which guides water poured from the water pocket 100 to the ice making trays. The water supply guiding portion may include a drip tray which receives water poured from the water pocket 100 and a channel portion which guides water of the drip tray to the ice making trays.

The drip tray may be formed in a plate shape to stably collect the water poured from the water pocket 100, and may be partitioned into a plurality of troughs by a partitioning rib 118 to receive water from each of a plurality of water storage spaces 107 and 108.

The water pocket 100 may include a partitioning rib insertion groove 110 in which the partitioning rib 118 is inserted such that water poured from the first water storage space 107 with water poured from the second water storage space 108 is not mixed when the water pocket 100 is rotated from a regular position to the lying position.

Figure 22:
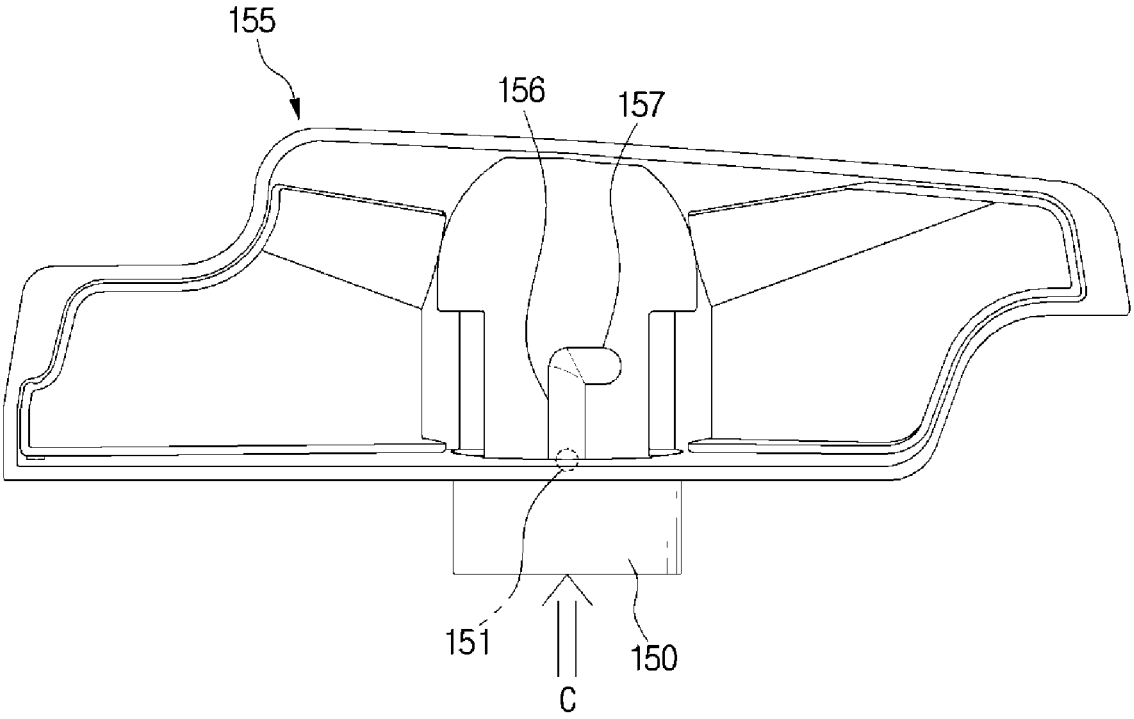
FIGS. 22 and 23 are views illustrating a holding structure of an ice discharge button of an ice bucket of an ice maker according to a third embodiment of the disclosure.
Figure 23:
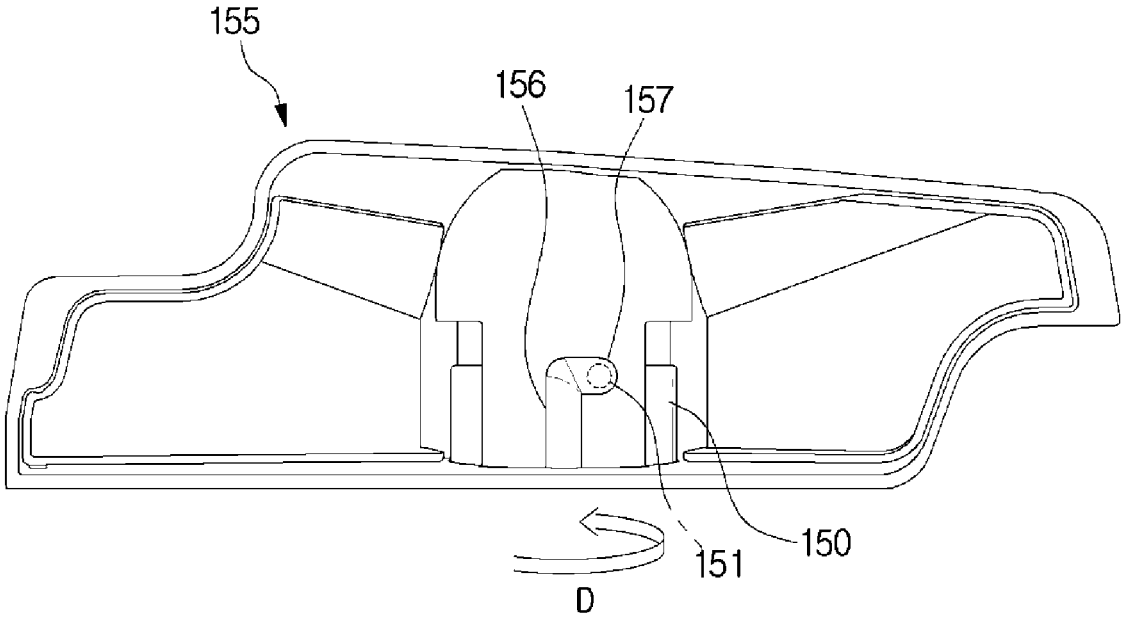

FIGS. 22 and 23 are views illustrating a holding structure of an ice discharge button of an ice bucket of an ice maker according to a third embodiment of the disclosure.

The ice maker according to the third embodiment of the disclosure will be described with reference to FIGS. 22 and 23. Like reference numerals refer to like elements as the embodiments described above, and descriptions thereof will be omitted.

Unlike the first embodiment described above, an ice discharge button 150 may further include a rotation holding protrusion 151, instead of an elastic holding protrusion, to be held in a closed state by an ice bucket body 155.

The rotation holding protrusion 151 may protrude to be fixed to a circumferential portion 143 of the ice discharge button 150.

The ice bucket body 155 includes a rotation holding protrusion path 156 which guides movement of the rotation holding protrusion 151 and a rotation holding groove 157 which holds the rotation holding protrusion 151.

The rotation holding protrusion path 156 may be formed at an inner circumferential surface of the ice bucket body 155 along an insertion and withdrawal direction (a direction C) of the ice discharge button 150. The rotation holding groove 157 may be formed at an end of the rotation holding protrusion path 156 along a rotation direction (a direction D) of the ice discharge button 150.

Through these components, when the ice discharge button 150 is inserted into an ice discharge button accommodating portion of the ice bucket body 155 in the direction C and is then rotated in the direction D, the rotation holding protrusion 151 is held by the rotation holding groove 157 such that the ice discharge button 150 may be maintained in the closed state despite an elastic force of an elastic member.

Figure 24:
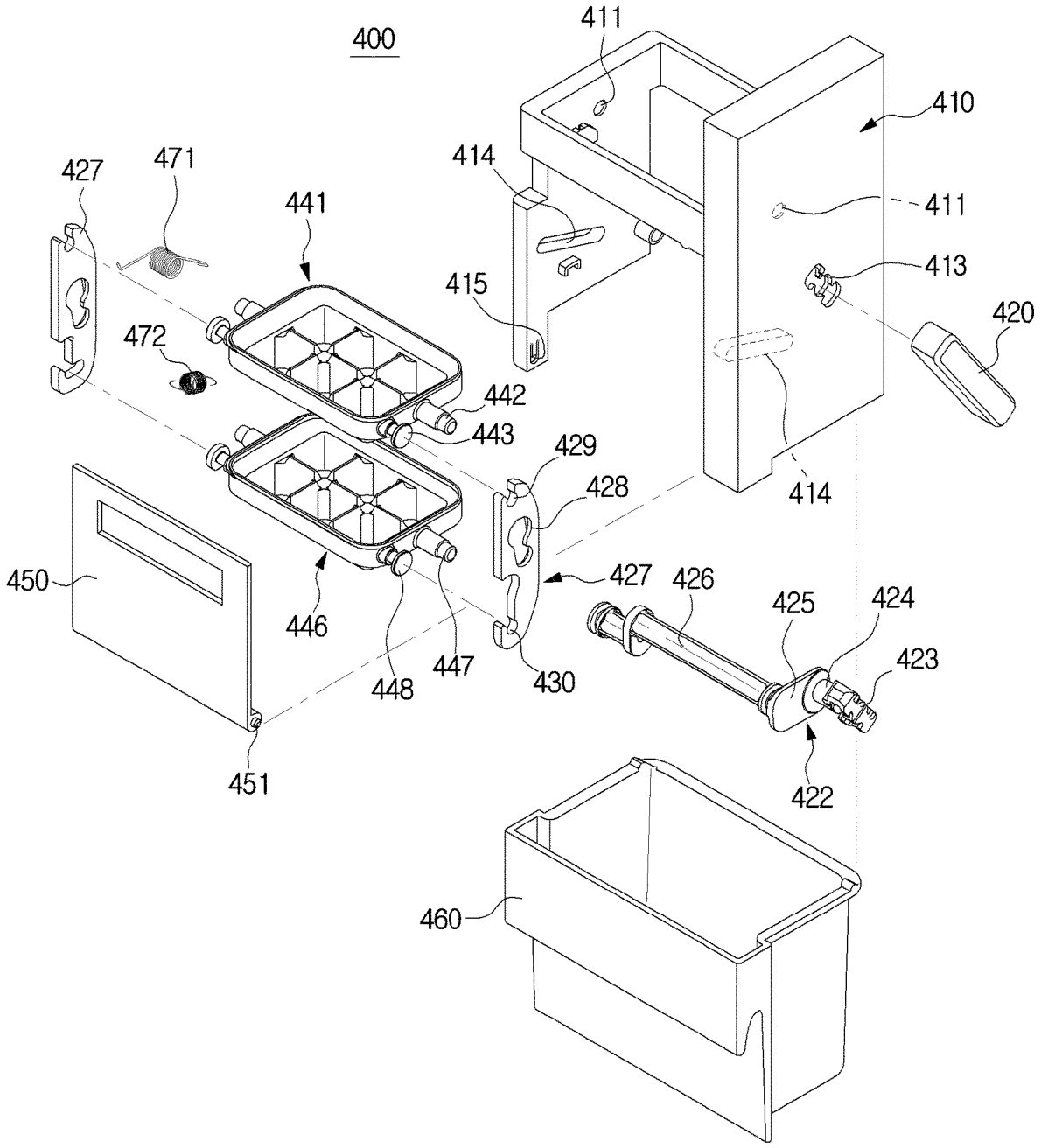
FIGS. 24 to 26 are views illustrating a configuration and an ice moving structure of an ice maker according to a fourth embodiment of the disclosure.
Figure 25:
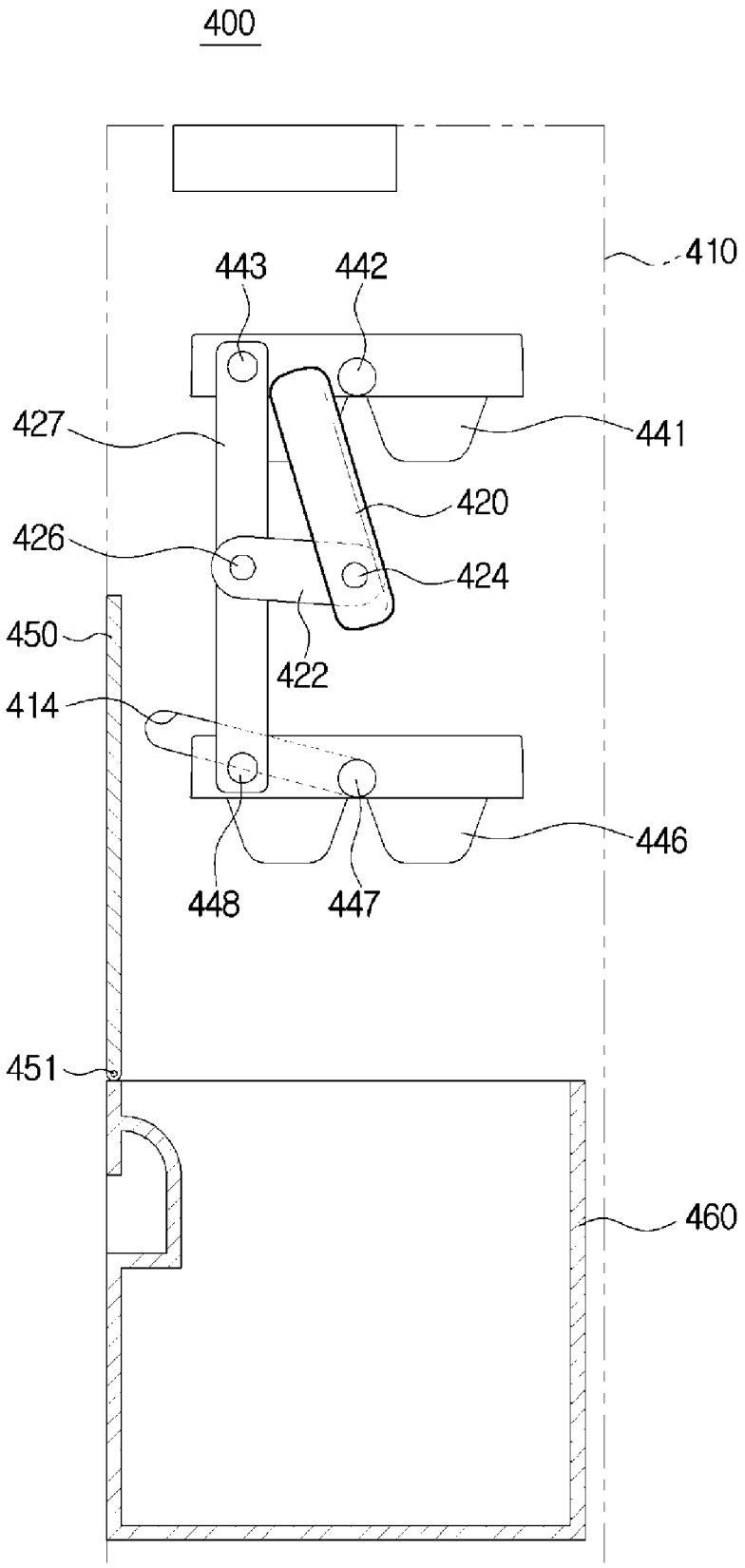
Figure 26:
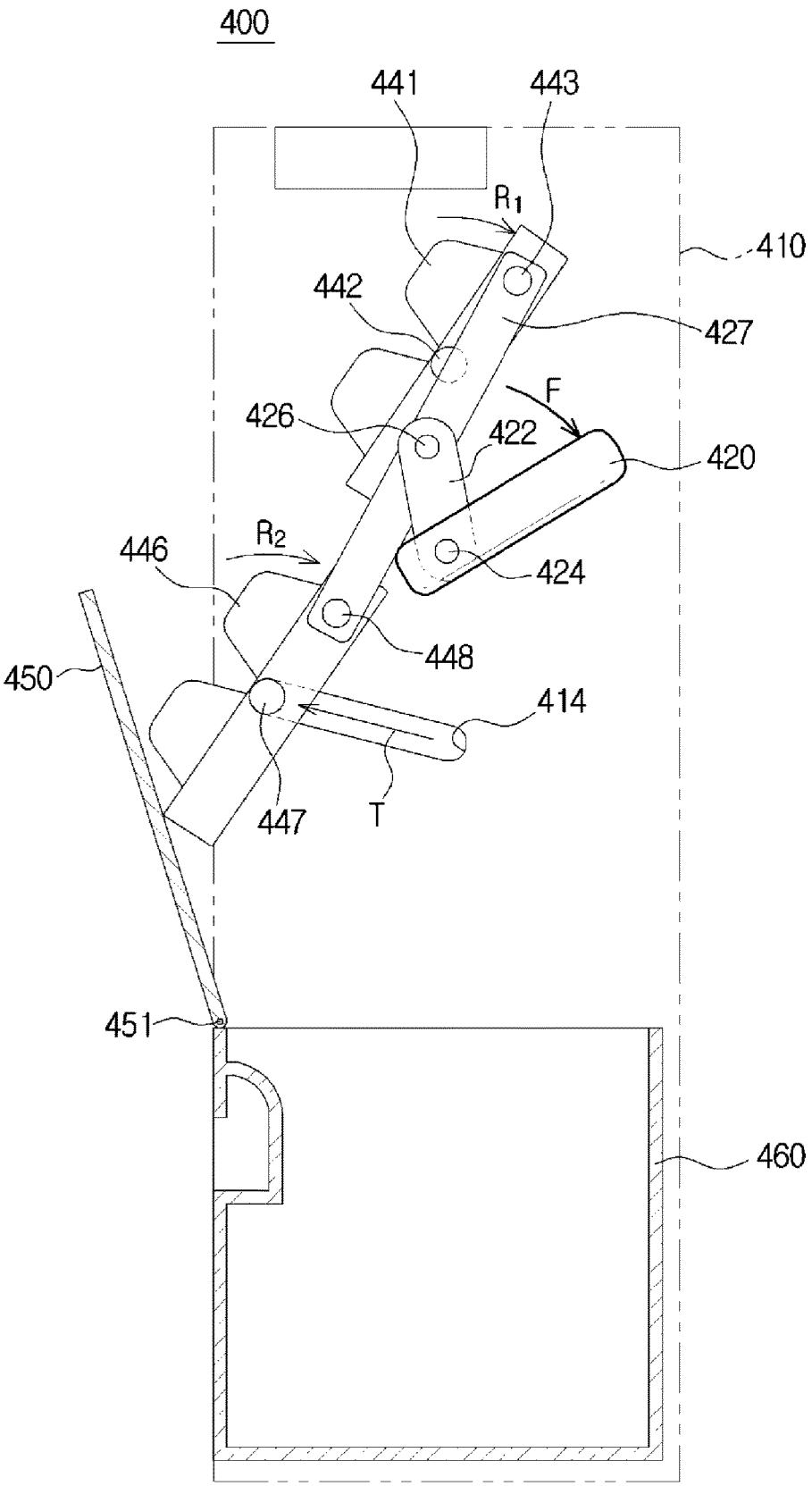

FIGS. 24 to 26 are views illustrating a configuration and an ice separating structure of an ice maker according to a fourth embodiment of the disclosure.

The ice maker according to the fourth embodiment of the disclosure will be described with reference to FIGS. 24 to 26. Like reference numerals refer to like elements as the embodiments described above, and descriptions thereof will be omitted.

An ice maker 400 may include a plurality of ice making trays 441 and 446 in which water is stored and frozen to make ice, a supporting frame 410 which supports the ice making trays 441 and 446, a lever 420 manually operated to separate the ice from the plurality of ice making trays 441 and 446, a link unit which connects the lever 420 to the plurality of ice making trays 441 and 446 to transfer a separating force to each of the plurality of ice making trays 441 and 446 when the lever 420 is operated, and an ice bucket 460 provided to store the ice separated from the ice making trays 441 and 446.

The plurality of ice making trays 441 and 446 may be mutually vertically arranged. In the embodiment, two such ice making trays 441 and 446 may be provided, but the number of ice making trays 441 and 446 may be three or more.

The ice making trays 441 and 446 may include a plurality of ice making cells which store water, and may be provided to be rotatable to separate ice from the plurality of ice making cells.

For this, the ice making trays 441 and 446 may include rotating shafts 442 and 447. The rotating shafts 442 and 447 may protrude in longitudinal directions of the ice making trays 441 and 446.

A first rotating shaft 442 of a first ice making tray 441 on top may be inserted in to a rotating shaft accommodating groove 411 of the supporting frame 410, and a second rotating shaft 447 of a second ice making tray 446 on bottom may be inserted into a linear movement guiding groove 414 of the supporting frame 410.

The ice making trays 441 and 446 may respectively include connecting pins 443 and 448 connected to a connecting member 427 of the link unit. The connecting pins 443 and 448 may be provided to be respectively spaced apart from the rotating shafts 442 and 447 by certain distances. Accordingly, when torque is applied by the connecting member 427 to the connecting pins 443 and 448, the ice making trays 441 and 446 may respectively rotate around the rotating shafts 442 and 447.

The ice maker 400 may include the lever 420 for rotating the ice making trays 441 and 446 to separate ice made in the ice making trays 441 and 446. The ice maker 400 may be provided to move the plurality of ice making trays 441 and 446 together by rotating the one lever 420.

The link unit may include a link shaft 422 and the connecting member 427.

The link shaft 422 may include a handle coupling portion 423 which is coupled to the lever 420, a first shaft portion 424 rotatably inserted in a link shaft accommodating groove 413 of the supporting frame 410, a second shaft portion 426 which rotates and is eccentric with the first shaft portion 424, and an extending portion 425 which connects the first shaft portion 424 to the second shaft portion 426.

The connecting member 427 connects the link shaft 422 to the plurality of ice making trays 441 and 446. The connecting member 427 may include a second shaft portion insertion groove 428 in which the second shaft portion 426 of the link shaft 422 is inserted, a first connecting pin insertion groove 429 in which a first connecting pin 443 of the first ice making tray 441 is inserted, and a second connecting pin insertion groove 430 in which a second connecting pin 448 of the second ice making tray 446 is inserted.

Hereinafter, based on FIGS. 25 and 26, a left side will be referred to as a front of the ice maker 400, and a right side will be referred to as a rear of the ice maker 400.

As shown in FIG. 25, the first rotating shaft 442 of the first ice making tray 441 and the second rotating shaft 447 of the second ice making tray 446 may be positioned on the same vertical line.

The first connecting pin 443 of the first ice making tray 441 may be positioned in front of the first rotating shaft 442, and the second connecting pin 448 of the second ice making tray 446 may be positioned in front of the second rotating shaft 447.

As shown in FIG. 26, when the lever 420 is rotated in a direction F, torque is transferred to the first ice making tray 441 and the second ice making tray 446 through the link unit.

Accordingly, the first ice making tray 441 rotates in a direction R1.

Also, the second ice making tray 446 rotates in a direction R2 and linearly moves forward. This is because the second rotating shaft 447 linearly moves in a direction T along the linear movement guiding groove 414 of the supporting frame 410 when the second ice making tray 446 rotates.

The ice maker 400 may further include an ice guiding member 450 which guides ice, which is separated from the second ice making tray 446 and falls while the second ice making tray 446 linearly moves forward, to the ice bucket 460.

The ice guiding member 450 may include a rotating pin 451 which protrudes from a lower end thereof, and the rotating pin 451 may be rotatably coupled to a supporting groove 415 of the supporting frame 410. The ice guiding member 450 may be initially closed, and then may be pressurized by the second ice making tray 446 to be opened and inclined forward when the second ice making tray 446 linearly moves forward. Accordingly, it is possible to guide the ice falling from the second ice making tray 446 to enter the ice bucket 460.

The ice maker 400 may include a rotational restoring member 471 which rotates the ice making trays 441 and 446 to restore them to their original positions when the lever 420 is released, and a linear restoring member 472 which linearly restores the ice making tray 446 to its original position. Also, the ice maker 400 may include an ice guiding member restoring member (not shown) which restores the ice guiding member 450 to its original position when the lever 420 is released.

Due to the configuration described above, the ice maker 400 may move the plurality of ice making trays 441 and 446 vertically arranged together using one lever 420.

Also, since the second ice making tray 446 on bottom linearly moves forward when the lever 420 is operated, ice falling from the first ice making tray 441 on top may not be caught by the second ice making tray 446 on bottom and may enter the ice bucket 460.

Also, as the ice guiding member 450 rotates forward when the lever 420 is operated, ice falling from the second ice making tray 446 may be guided by the ice guiding member 450 to the ice bucket 460.

Accordingly, it is possible to design a slim forward-and-backward width of an ice maker including a plurality of ice making trays vertically arranged.

Figure 27:
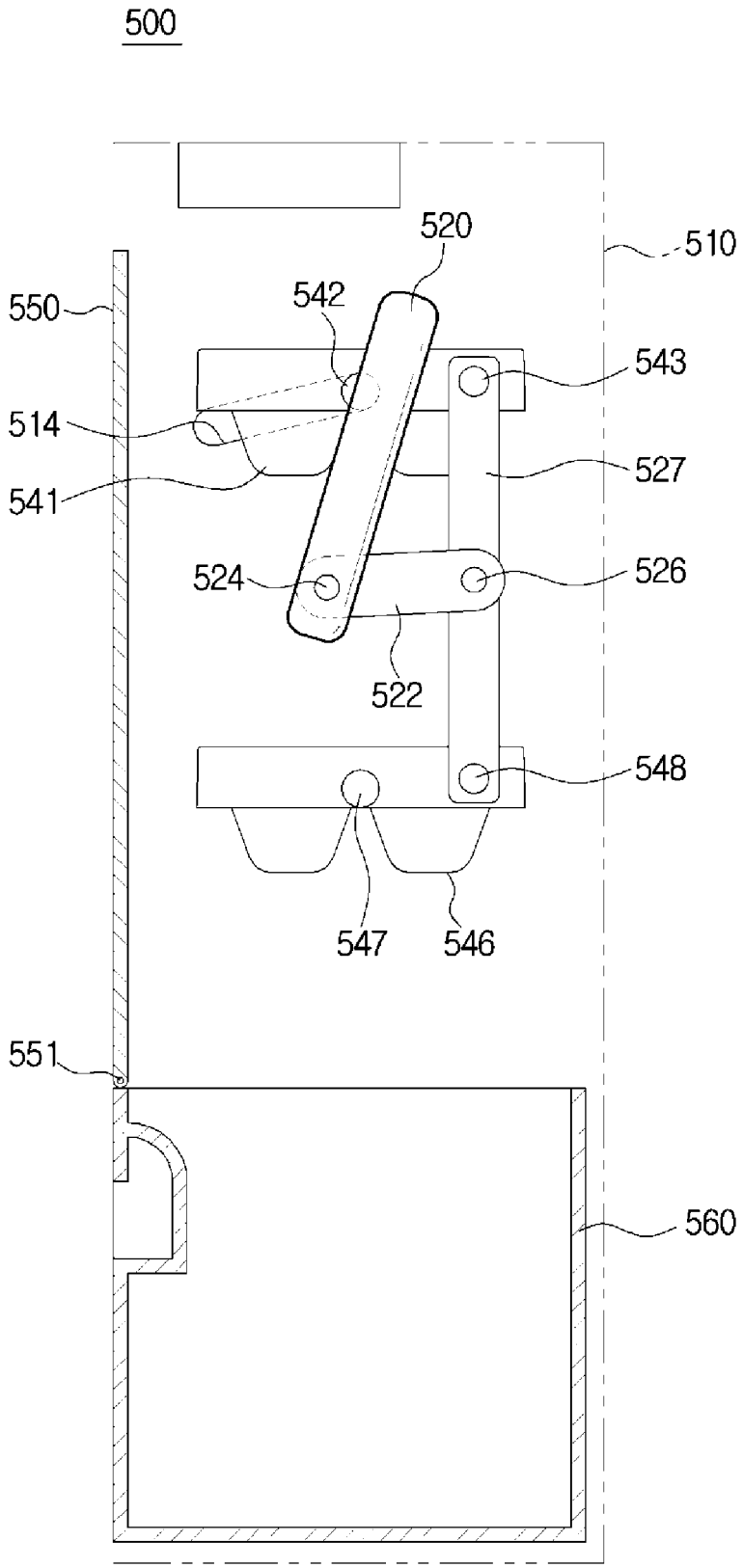
FIGS. 27 and 28 are views illustrating a configuration and an ice moving structure of an ice maker according to a fifth embodiment of the disclosure.
Figure 28:
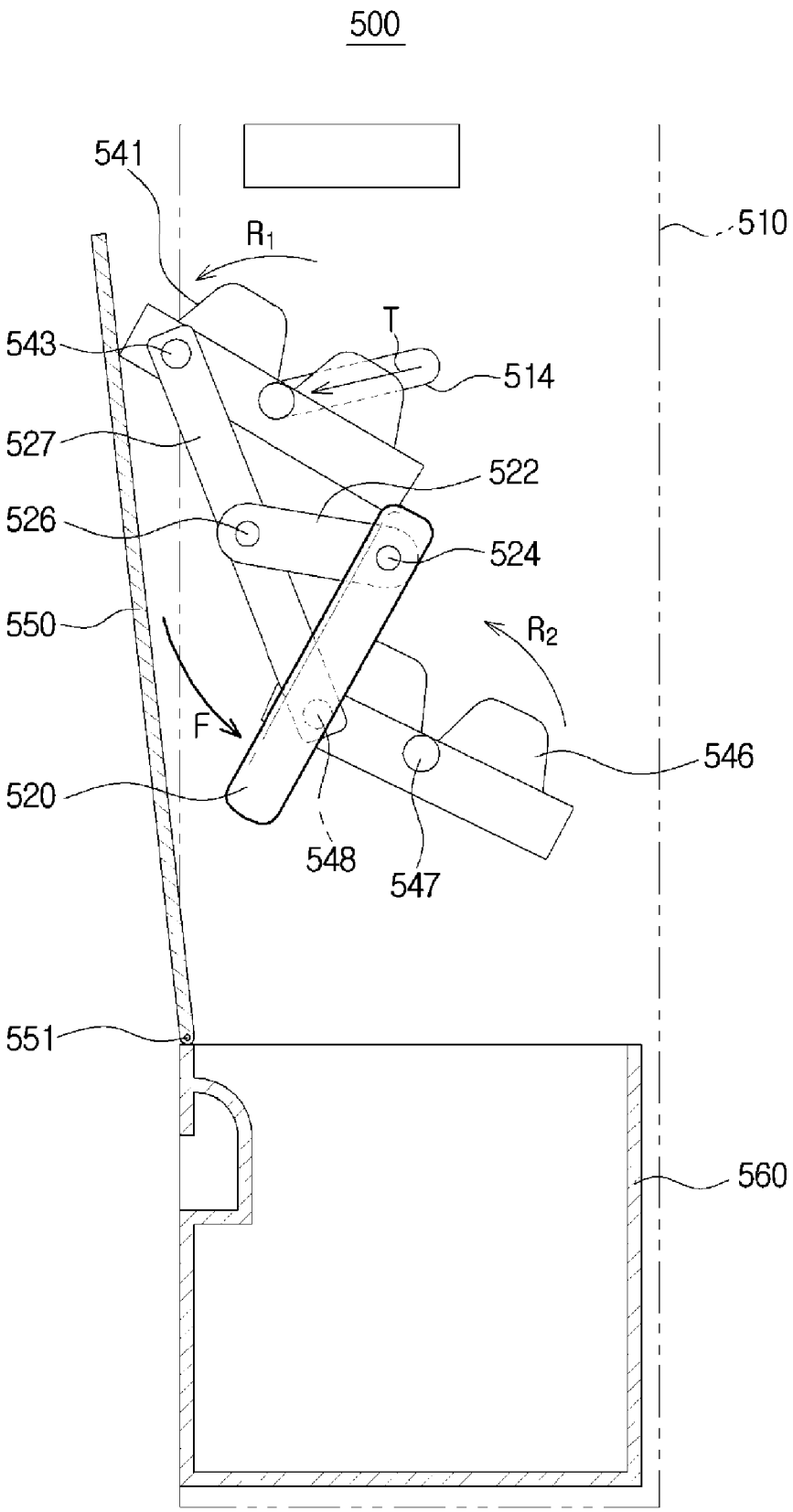

FIGS. 27 and 28 are views illustrating a configuration and an ice separating structure of an ice maker according to a fifth embodiment of the disclosure.

The ice maker according to the fifth embodiment of the disclosure will be described with reference to FIGS. 27 and 28. Like reference numerals refer to like elements as the embodiments described above, and descriptions thereof will be omitted.

Although the second ice making tray 446 on bottom is provided to linearly move forward when a handle is operated in the fourth embodiment described above, a first ice making tray 541 on top may be provided to linearly move forward when a handle is operated.

An ice maker 500 may include a plurality of ice making trays 541 and 546 in which water is stored and frozen to make ice, a supporting frame 510 which supports the ice making trays 541 and 546, a lever 520 manually operated to separate the ice from the plurality of ice making trays 541 and 546, a link unit which connects the lever 520 to the plurality of ice making trays 541 and 546 to transfer a separating force to each of the plurality of ice making trays 541 and 546 when the lever 520 is operated, and an ice bucket 560 provided to store the ice separated from the ice making trays 541 and 546.

The plurality of ice making trays 541 and 546 may be mutually vertically arranged. In the embodiment, two such ice making trays 541 and 546 may be provided, but the number of ice making trays 541 and 546 may be three or more.

The ice making trays 541 and 546 may include a plurality of ice making cells which store water, and may be provided to be rotatable to separate ice from the plurality of ice making cells.

For this, the ice making trays 541 and 546 may include rotating shafts 542 and 547. The rotating shafts 542 and 547 may protrude in longitudinal directions of the ice making trays 541 and 546.

A first rotating shaft 542 of the first ice making tray 541 on top may be inserted in a linear movement guiding groove 514 of the supporting frame 510.

The ice making trays 541 and 546 may respectively include connecting pins 543 and 548 connected to a connecting member 527 of the link unit. The link unit may include a link shaft 522 and the connecting member 527.

The link shaft 522 may include a handle coupling portion which is coupled to the lever 520, a first shaft portion 524 rotatably inserted in a link shaft accommodating groove of the supporting frame 510, a second shaft portion 526 which rotates and is eccentric with the first shaft portion 524, and an extending portion which connects the first shaft portion 524 to the second shaft portion 526.

Hereinafter, based on FIGS. 27 and 28, a left side will be referred to as a front of the ice maker 500, and a right side will be referred to as a rear of the ice maker 500.

As shown in FIG. 27, the first rotating shaft 542 of the first ice making tray 541 and the second rotating shaft 547 of the second ice making tray 546 may be positioned on the same vertical line.

The first connecting pin 543 of the first ice making tray 541 may be positioned behind the first rotating shaft 542, and the second connecting pin 548 of the second ice making tray 546 may be positioned behind the second rotating shaft 547.

As shown in FIG. 28, when the lever 520 is rotated in a direction F, torque is transferred to the first ice making tray 541 and the second ice making tray 546 through the link unit.

Accordingly, the first ice making tray 541 rotates in a direction R1 and linearly moves forward. This is because the first rotating shaft 542 linearly moves in a direction T along the linear movement guiding groove 514 of the supporting frame 510 when the first ice making tray 541 rotates.

Also, the second ice making tray 546 rotates in a direction R2.

The ice maker 500 may further include an ice guiding member 550 which guides ice, which is separated from the first ice making tray 541 and falls while the first ice making tray 541 linearly moves forward, to the ice bucket 560.

The ice guiding member 550 may include a rotating pin 551 which protrudes from a lower end thereof, and the rotating pin 551 may be rotatably coupled to the supporting frame 510. The ice guiding member 550 may be initially closed, and then may be pressurized by the first ice making tray 541 to be opened and inclined forward when the first ice making tray 541 linearly moves forward. Accordingly, it is possible to guide the ice falling from the first ice making tray 541 to enter the ice bucket 560.

Due to the configuration described above, the ice maker 500 may move the plurality of ice making trays 541 and 546 vertically arranged together using one lever 520.

Also, since the first ice making tray 541 on top linearly moves forward when the lever 520 is operated, ice falling from the first ice making tray 541 on top may not be caught by the second ice making tray 546 on bottom.

Also, as the ice guiding member 550 rotates forward when the lever 520 is operated, the ice falling from the first ice making tray 541 may be guided by the ice guiding member 550 to the ice bucket 560.

Accordingly, it is possible to design a slim forward-and-backward width of an ice maker including a plurality of ice making trays vertically arranged.

Figure 29:
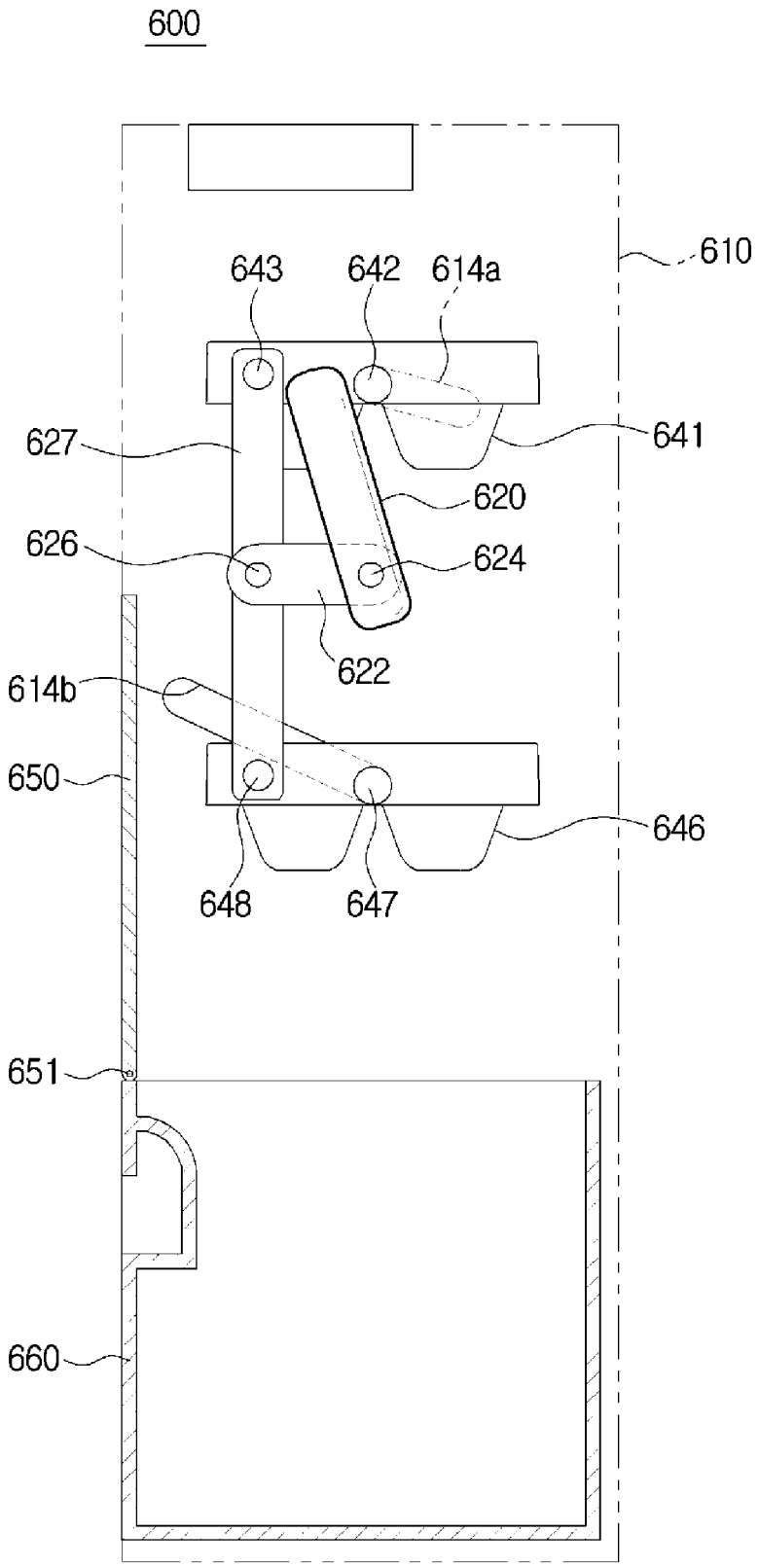
FIGS. 29 and 30 are views illustrating a configuration and an ice moving structure of an ice maker according to a sixth embodiment of the disclosure.
Figure 30:
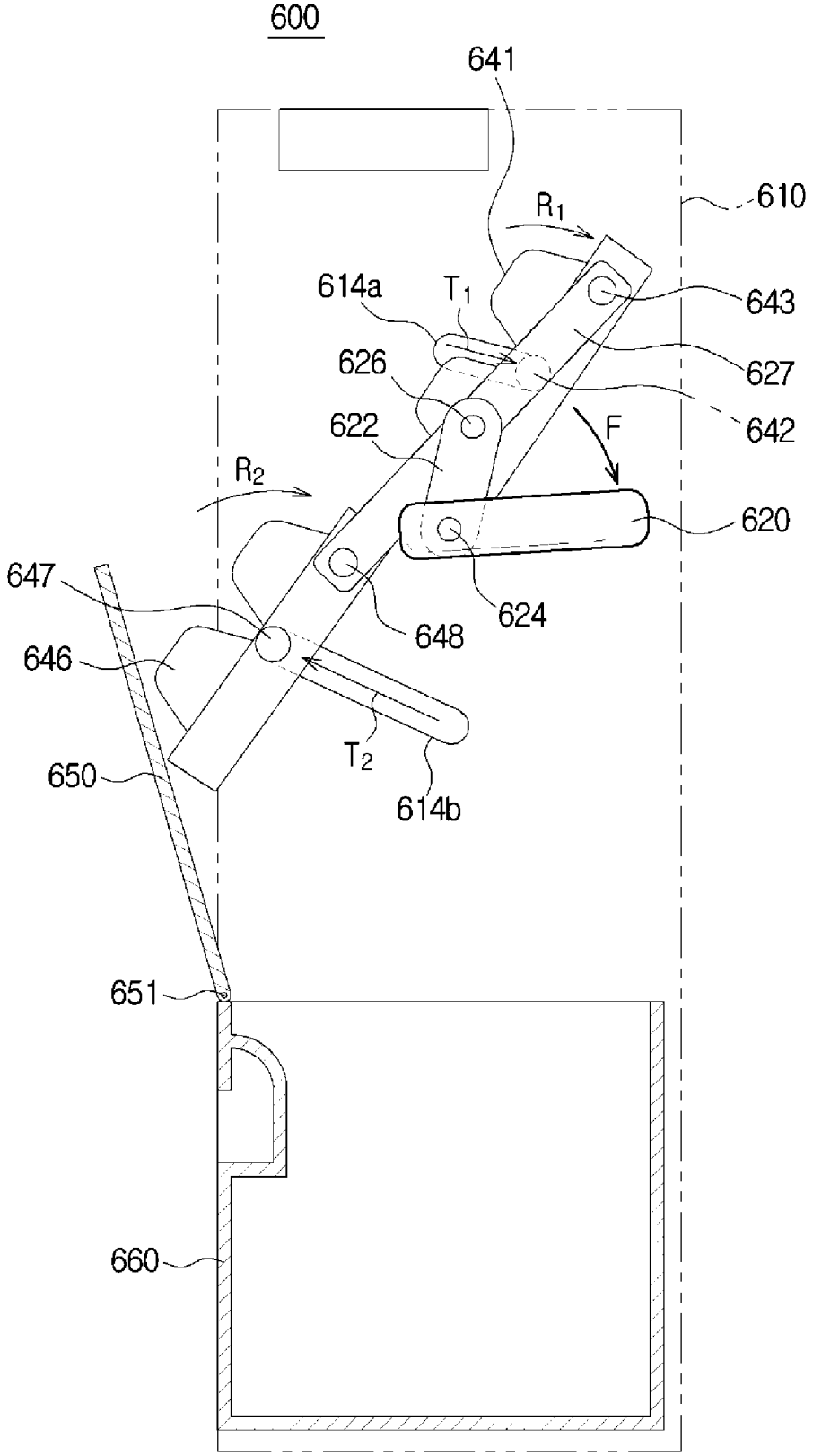

FIGS. 29 and 30 are views illustrating a configuration and an ice separating structure of an ice maker according to a sixth embodiment of the disclosure.

The ice maker according to the sixth embodiment of the disclosure will be described with reference to FIGS. 29 and 30. Like reference numerals refer to like elements as the embodiments described above, and descriptions thereof will be omitted.

In the fourth embodiment and the fifth embodiment, when the handle is operated, any one of the first ice making tray on top and the second ice making tray on bottom is configured to linearly move forward. However, a first ice making tray 641 on top may be configured to linearly move backward, and a second ice making tray 646 on bottom may be configured to linearly move forward.

An ice maker 600 may include a plurality of ice making trays 641 and 646 in which water is stored and frozen to make ice, a supporting frame 610 which supports the ice making trays 641 and 646, a lever 620 manually operated to separate the ice from the plurality of ice making trays 641 and 646, a link unit which connects the lever 620 to the plurality of ice making trays 641 and 646 to transfer a separating force to each of the plurality of ice making trays 641 and 646 when the lever 620 is operated, and an ice bucket 660 provided to store the ice separated from the ice making trays 641 and 646.

The plurality of ice making trays 641 and 646 may be mutually vertically arranged. In the embodiment, two such ice making trays 641 and 646 may be provided, but the number of ice making trays 641 and 646 may be three or more.

The ice making trays 641 and 646 may include a plurality of ice making cells which store water, and may be provided to be rotatable to separate ice from the plurality of ice making cells.

For this, the ice making trays 641 and 646 may include rotating shafts 642 and 647. The rotating shafts 642 and 647 may protrude in longitudinal directions of the ice making trays 641 and 646.

A first rotating shaft 642 of the first ice making tray 641 on top may be inserted in a first linear movement guiding groove 614*a* of the supporting frame 610. A second rotating shaft 647 of the second ice making tray 646 on bottom may be inserted in a second linear movement guiding groove 614*b* of the supporting frame 610.

The ice making trays 641 and 646 may include connecting pins 643 and 648 connected to a connecting member 627 of the link unit. The link unit may include a link shaft 622 and the connecting member 627.

The link shaft 622 may include a handle coupling portion which is coupled to the lever 620, a first shaft portion 624 rotatably inserted in a link shaft accommodating groove of the supporting frame 610, a second shaft portion 626 which rotates and is eccentric with the first shaft portion 624, and an extending portion which connects the first shaft portion 624 to the second shaft portion 626.

Hereinafter, based on FIGS. 29 and 30, a left side will be referred to as a front of the ice maker 600, and a right side will be referred to as a rear of the ice maker 600.

As shown in FIG. 29, the first rotating shaft 642 of the first ice making tray 641 and the second rotating shaft 647 of the second ice making tray 646 may be positioned on the same vertical line.

The first connecting pin 643 of the first ice making tray 641 may be positioned in front of the first rotating shaft 642, and the second connecting pin 648 of the second ice making tray 646 may be positioned in front of the second rotating shaft 647.

As shown in FIG. 30, when the lever 620 is rotated in a direction F, torque is transferred to the first ice making tray 641 and the second ice making tray 646 through the link unit.

Accordingly, the first ice making tray 641 rotates in a direction R1 and linearly moves backward. This is because the first rotating shaft 642 linearly moves in a direction T1 along the linear movement guiding groove 614*a* of the supporting frame 610 when the first ice making tray 641 rotates.

Also, the second ice making tray 646 rotates in a direction R2 and linearly moves forward. This is because the second rotating shaft 647 linearly moves in a direction T2 along the linear movement guiding groove 614*b* of the supporting frame 610 when the second ice making tray 646 rotates.

The ice maker 600 may further include an ice guiding member 650 which guides ice, which is separated from the second ice making tray 646 and falls while the second ice making tray 646 linearly moves forward, to the ice bucket 660.

The ice guiding member 650 may include a rotating pin 651 which protrudes from a lower end thereof, and the rotating pin 651 may be rotatably coupled to the supporting frame 610. The ice guiding member 650 may be initially closed, and then may be pressurized by the second ice making tray 646 to be opened and inclined forward when the second ice making tray 646 linearly moves forward. Accordingly, it is possible to guide the ice falling from the second ice making tray 646 to enter the ice bucket 660.

Due to the configuration described above, the ice maker 600 may move the plurality of ice making trays 641 and 646 vertically arranged together using one lever 620.

Also, since the first ice making tray 641 on top linearly moves backward and the second ice making tray 646 on bottom linearly moves forward when the lever 620 is operated, ice falling from the first ice making tray 641 on top may not be caught by the second ice making tray 646 and may enter the ice bucket 660.

Also, as the ice guiding member 650 rotates forward when the lever 620 is operated, ice falling from the second ice making tray 646 may be guided by the ice guiding member 650 to the ice bucket 660.

Accordingly, it is possible to design a slim forward-and-backward width of an ice maker including a plurality of ice making trays vertically arranged.

Figure 31:
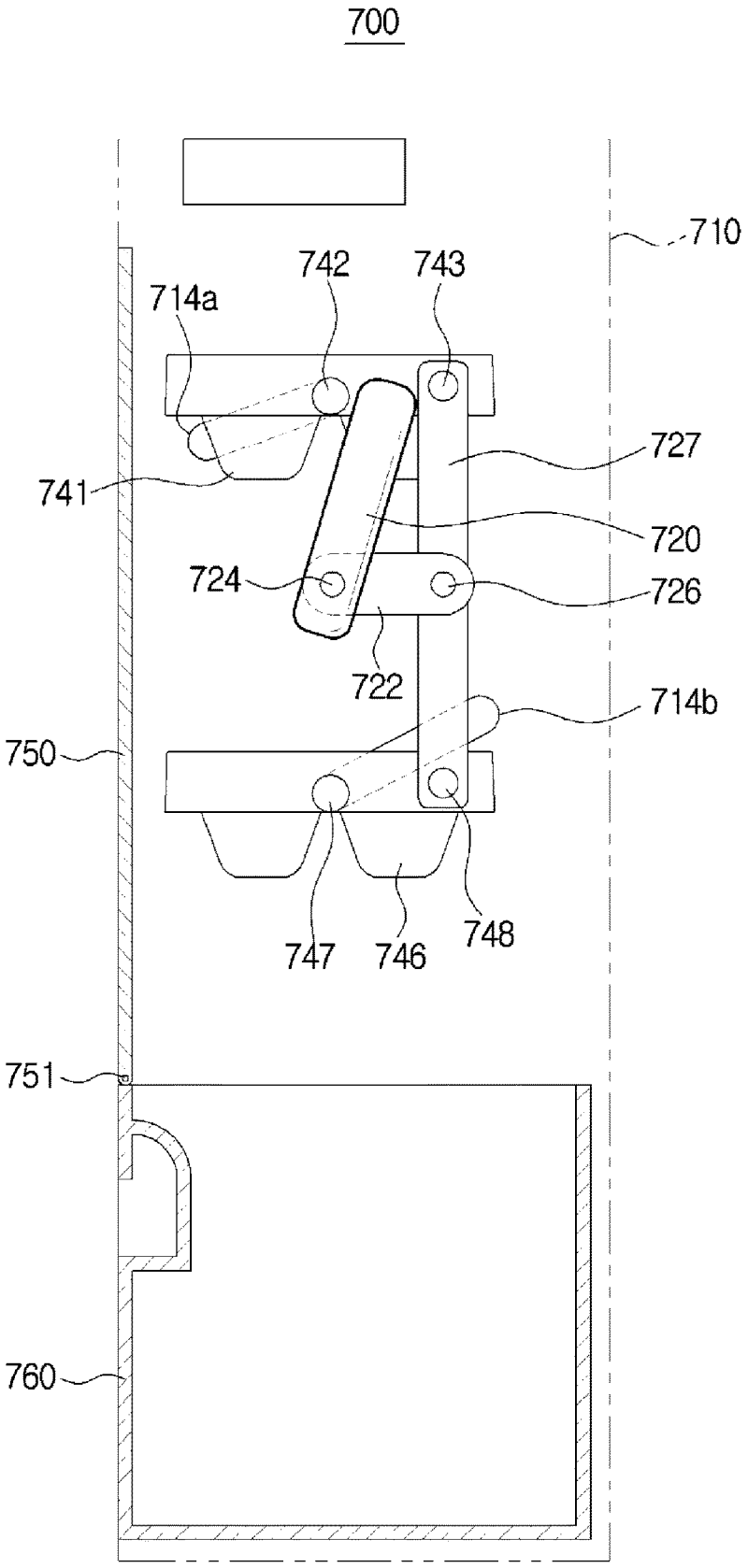
FIGS. 31 and 32 are views illustrating a configuration and an ice moving structure of an ice maker according to a seventh embodiment of the disclosure.
Figure 32:
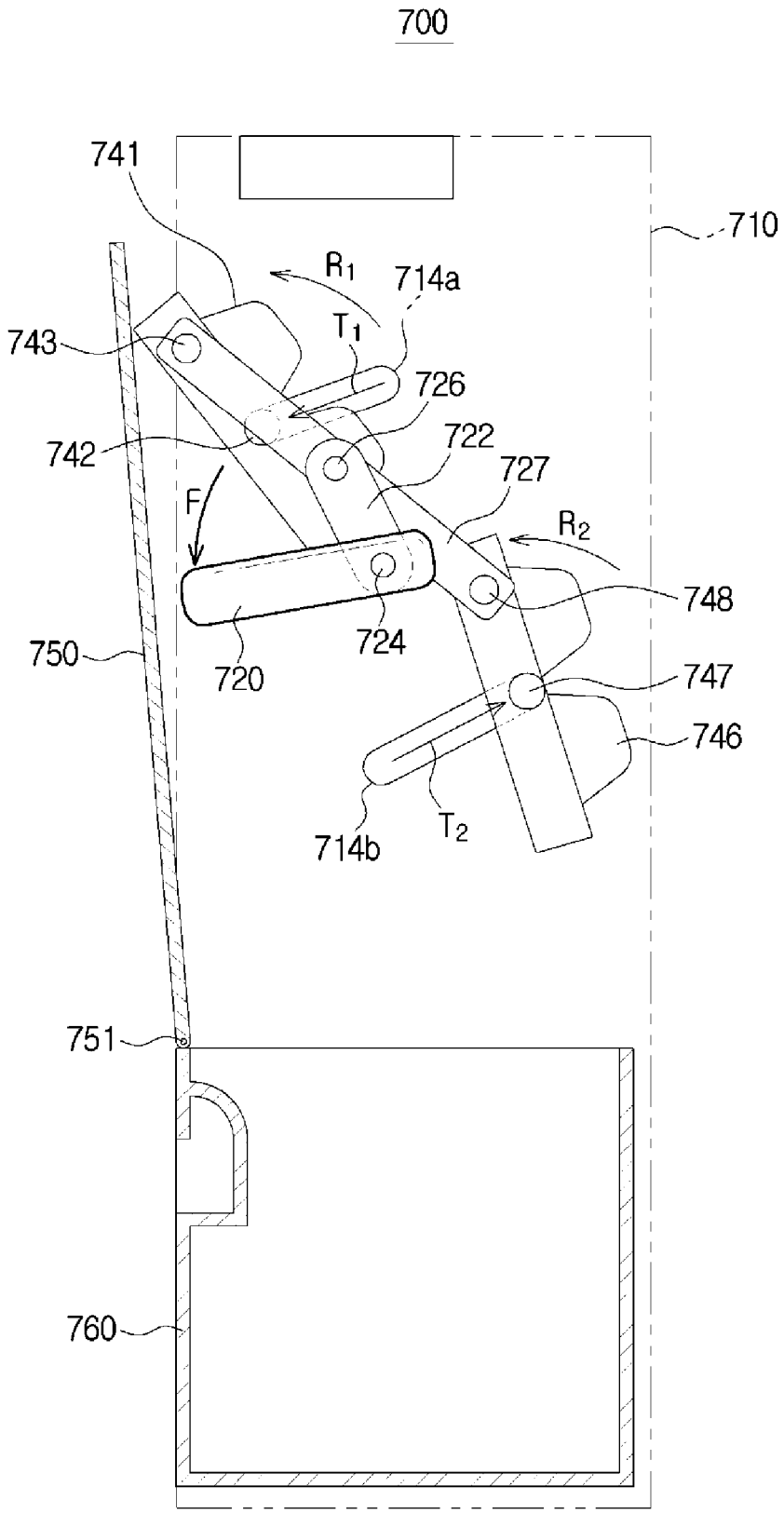

FIGS. 31 and 32 are views illustrating a configuration and an ice moving structure of an ice maker according to a seventh embodiment of the disclosure.

The ice maker according to the seventh embodiment of the disclosure will be described with reference to FIGS. 31 and 32. Like reference numerals refer to like elements as the embodiments described above, and descriptions thereof will be omitted.

In the sixth embodiment, when a handle is operated, the first ice making tray 641 on top linearly moves backward and the second ice making tray 646 on bottom linearly moves forward. However, a first ice making tray 741 on top may linearly move forward and a second ice making tray 746 on bottom may linearly move backward.

An ice maker 700 may include a plurality of such ice making trays 741 and 746 in which water is stored and frozen to make ice, a supporting frame 710 which supports the ice making trays 741 and 746, a lever 720 manually operated to separate the ice from the plurality of ice making trays 741 and 746, a link unit which connects the lever 720 with the plurality of ice making trays 741 and 746 to transfer a separating force to each of the plurality of ice making trays 741 and 746 when the lever 720 is operated, and an ice bucket 760 provided to store the ice separated from the ice making trays 741 and 746.

The plurality of ice making trays 741 and 746 may be mutually vertically arranged. In the embodiment, two such ice making trays 741 and 746 may be provided, but the number of ice making trays 741 and 746 may be three or more.

The ice making trays 741 and 746 may include a plurality of ice making cells which store water, and may be provided to be rotatable to separate ice from the plurality of ice making cells.

For this, the ice making trays 741 and 746 may include rotating shafts 742 and 747. The rotating shafts 742 and 747 may protrude in longitudinal directions of the ice making trays 741 and 746.

A first rotating shaft 742 of the first ice making tray 741 on top may be inserted in a first linear movement guiding groove 714*a* of the supporting frame 710. A second rotating shaft 747 of the second ice making tray 746 on bottom may be inserted in a second linear movement guiding groove 714*b* of the supporting frame 710.

The ice making trays 741 and 746 may respectively include connecting pins 743 and 748 connected to a connecting member 727 of the link unit. The link unit may include a link shaft 722 and the connecting member 727.

The link shaft 722 may include a handle coupling portion which is coupled to the lever 720, a first shaft portion 724 rotatably inserted in a link shaft accommodating groove of the supporting frame 710, a second shaft portion 726 which rotates and is eccentric with the first shaft portion 724, and an extending portion which connects the first shaft portion 724 to the second shaft portion 726.

Hereinafter, based on FIGS. 31 and 32, a left side will be referred to as a front of the ice maker 700, and a right side will be referred to as a rear of the ice maker 700.

As shown in FIG. 31, the first rotating shaft 742 of the first ice making tray 741 and the second rotating shaft 747 of the second ice making tray 746 may be positioned on the same vertical line.

The first connecting pin 743 of the first ice making tray 741 may be positioned behind the first rotating shaft 742, and the second connecting pin 748 of the second ice making tray 746 may be positioned behind the second rotating shaft 747.

As shown in FIG. 32, when the lever 720 is rotated in a direction F, torque is transferred to the first ice making tray 741 and the second ice making tray 746 through the link unit.

Accordingly, the first ice making tray 741 rotates in a direction R1 and linearly moves forward. This is because the first rotating shaft 742 linearly moves in a direction T1 along the linear movement guiding groove 714*a* of the supporting frame 710 when the first ice making tray 741 rotates.

Also, the second ice making tray 746 rotates in a direction R2 and linearly moves backward. This is because the second rotating shaft 747 linearly moves in a direction T2 along the linear movement guiding groove 714*b* of the supporting frame 710 when the second ice making tray 746 rotates.

The ice maker 700 may further include an ice guiding member 750 which guides ice, which is separated from the first ice making tray 741 and falls while the first ice making tray 741 linearly moves forward, to the ice bucket 760.

The ice guiding member 750 may include a rotating pin 751 which protrudes from a lower end thereof, and the rotating pin 751 may be rotatably coupled to the supporting frame 710. The ice guiding member 750 may be initially closed, and then may be pressurized by the first ice making tray 741 to be opened and inclined forward when the first ice making tray 741 linearly moves forward. Accordingly, it is possible to guide the ice falling from the first ice making tray 741 to enter the ice bucket 760.

Due to the configuration described above, the ice maker 700 may move the plurality of ice making trays 741 and 746 vertically arranged together using one lever 720.

Also, since the first ice making tray 741 on top linearly moves forward and the second ice making tray 746 on bottom linearly moves forward when the lever 720 is operated, ice falling from the first ice making tray 741 on top may not be caught by the second ice making tray 746 and may enter the ice bucket 760.

Also, as the ice guiding member 750 rotates forward when the lever 720 is operated, the ice falling from the first ice making tray 741 may be guided by the ice guiding member 750 to the ice bucket 760.

Accordingly, it is possible to design a slim forward-and-backward width of an ice maker including a plurality of ice making trays vertically arranged.

Figure 33:
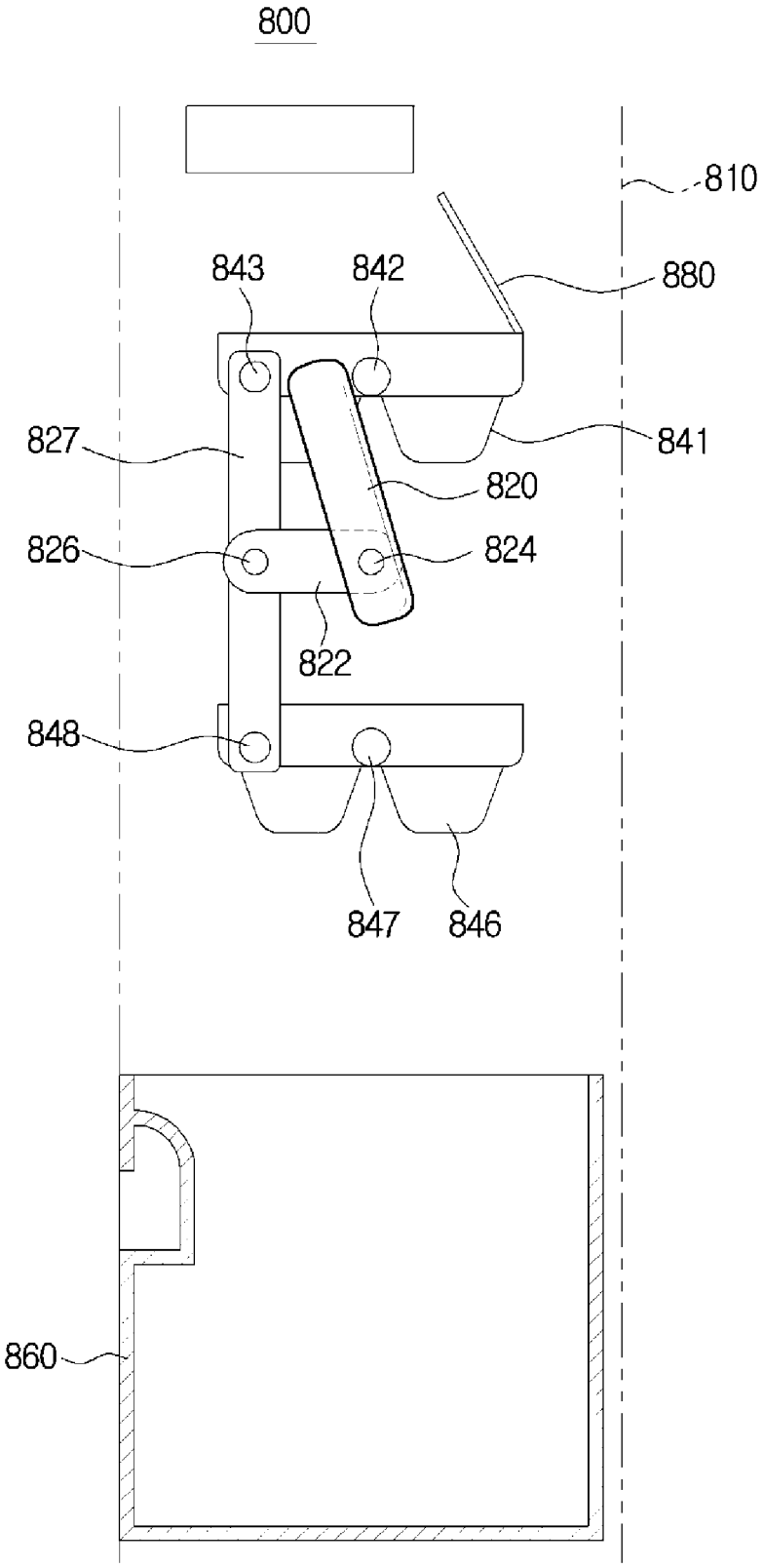
FIGS. 33 and 34 are views illustrating a configuration and an ice moving structure of an ice maker according to an eighth embodiment of the disclosure.
Figure 34:
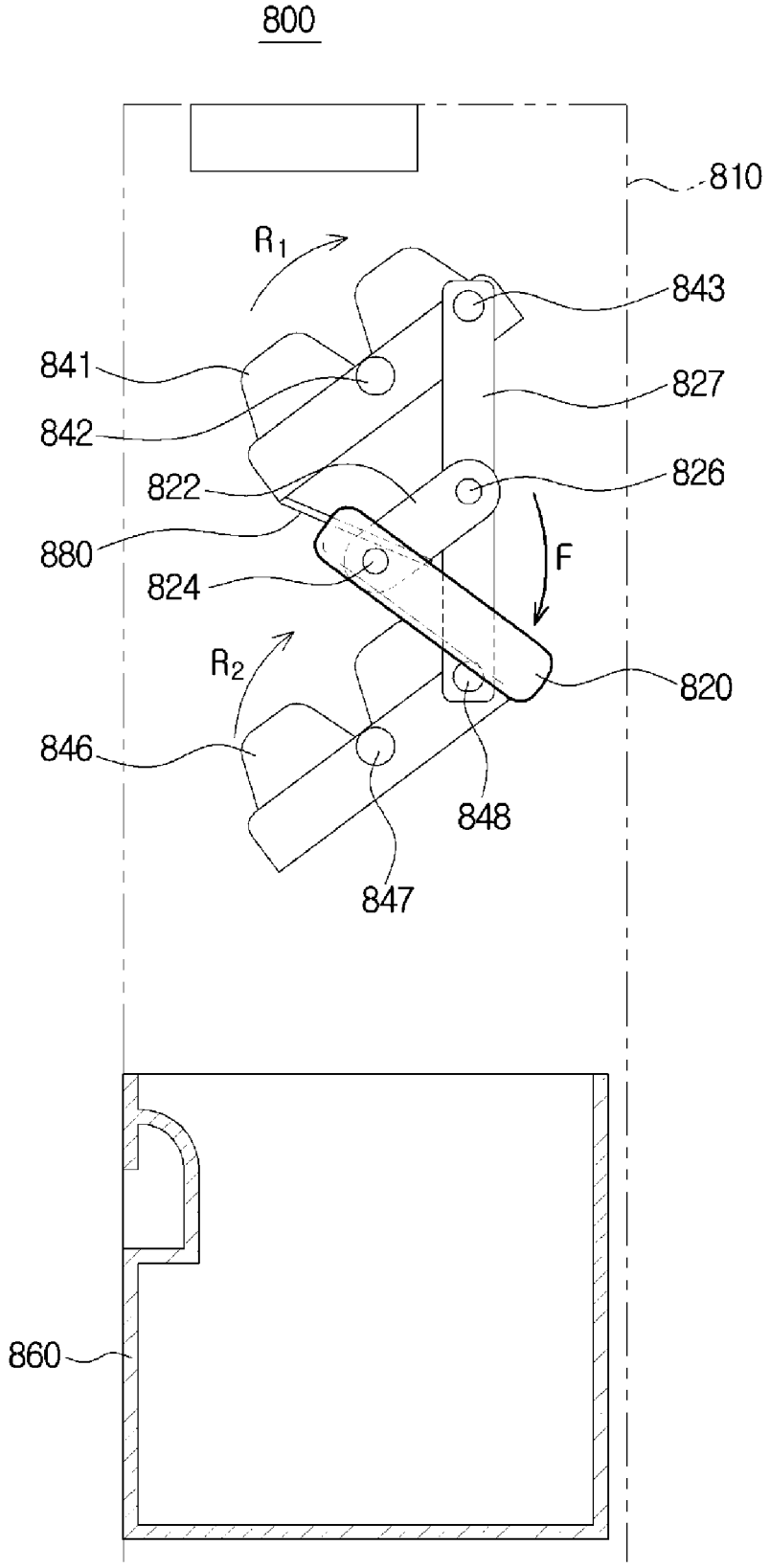

FIGS. 33 and 34 are views illustrating a configuration and an ice moving structure of an ice maker according to an eighth embodiment of the disclosure.

The ice maker according to the eighth embodiment of the disclosure will be described with reference to FIGS. 33 and 34. Like reference numerals refer to like elements as the embodiments described above, and descriptions thereof will be omitted.

In the fourth embodiment to the seventh embodiment described above, at least one of an ice making tray on top and an ice making tray on bottom is configured to linearly move in such a way that ice falling from the ice making tray on top may not be caught by the ice making tray on bottom and may enter an ice bucket. However, ice making trays are not configured to linearly move but an ice maker may include an ice holding preventing member 880 which guides ice in such a way that ice falling from an ice making tray on top may not be caught by an ice making tray on bottom.

An ice maker 800 may include a plurality of ice making trays 841 and 846 in which water is stored and frozen to make ice, a supporting frame 810 which supports the ice making trays 841 and 846, a lever 820 manually operated to separate the ice from the plurality of ice making trays 841 and 846, a link unit which connects the lever 820 to the plurality of ice making trays 841 and 846 to transfer a separating force to each of the plurality of ice making trays 841 and 846 when the lever 820 is operated, and an ice bucket 860 provided to store the ice separated from the ice making trays 841 and 846.

The plurality of ice making trays 841 and 846 may be mutually vertically arranged. In the embodiment, two such ice making trays 841 and 846 may be provided, but the number of ice making trays 841 and 846 may be three or more.

The ice making trays 841 and 846 may include a plurality of ice making cells which store water, and may be provided to be rotatable to separate ice from the plurality of ice making cells.

For this, the ice making trays 841 and 846 may include rotating shafts 842 and 847. The rotating shafts 842 and 847 may protrude in longitudinal directions of the ice making trays 841 and 846.

The ice making trays 841 and 846 may include connecting pins 843 and 848 connected to a connecting member 827 of the link unit. The link unit may include a link shaft 822 and the connecting member 827.

The link shaft 822 may include a handle coupling portion which is coupled to the lever 820, a first shaft portion 824 rotatably inserted in a link shaft accommodating groove of the supporting frame 810, a second shaft portion 826 which rotates and is eccentric with the first shaft portion 824, and an extending portion which connects the first shaft portion 824 to the second shaft portion 826.

The ice holding preventing member 880 may be provided at one side of a first ice making tray 841. The ice holding preventing member 880 may be integrated with the first ice making tray 841, and may be separately provided and assembled with the first ice making tray 841.

The ice holding preventing member 880 may be inclined such that ice falling from the first ice making tray 841 may not be caught by a second ice making tray 846 when the first ice making tray 841 rotates.

The ice holding preventing member 880 may be formed of a flexible material such as silicone, and may include a slit (not shown) through which cool air passes such that circulation of the cool air is not interfered with.

However, unlike the embodiment, the ice holding preventing member 880 may be provided at the second ice making tray 846 on bottom not at the first ice making tray 841 on top.

As shown in FIG. 33, the first rotating shaft 842 of the first ice making tray 841 and the second rotating shaft 847 of the second ice making tray 846 may be positioned on the same vertical line.

The first connecting pin 843 of the first ice making tray 841 may be positioned in front of the first rotating shaft 842, and the second connecting pin 848 of the second ice making tray 846 may be positioned in front of the second rotating shaft 847.

As shown in FIG. 34, when the lever 820 is rotated in a direction F, torque is transferred to the first ice making tray 841 and the second ice making tray 846 through the link unit.

Accordingly, the first ice making tray 841 rotates in a direction R1, and the second ice making tray 846 rotates in a direction R2.

Here, the ice holding preventing member 880 provided at the first ice making tray 841 also rotates together with the first ice making tray 841 and is disposed to be inclined and guides ice separated from the first ice making tray 841 not to be caught by the second ice making tray 846 and to enter the ice bucket 860.

Due to the configuration described above, the ice maker 800 may move the plurality of ice making trays 841 and 846 vertically arranged together using one lever 820.

Also, when the lever 820 is operated, the ice holding preventing member 880 is disposed between the first ice making tray 841 on top and the second ice making tray 846 on bottom to be inclined such that ice falling from the first ice making tray 841 on top may not be caught by the second ice making tray 846 on bottom and may enter the ice bucket 860.

Accordingly, it is possible to design a slim forward-and-backward width of an ice maker including a plurality of ice making trays vertically arranged.

Figure 35:
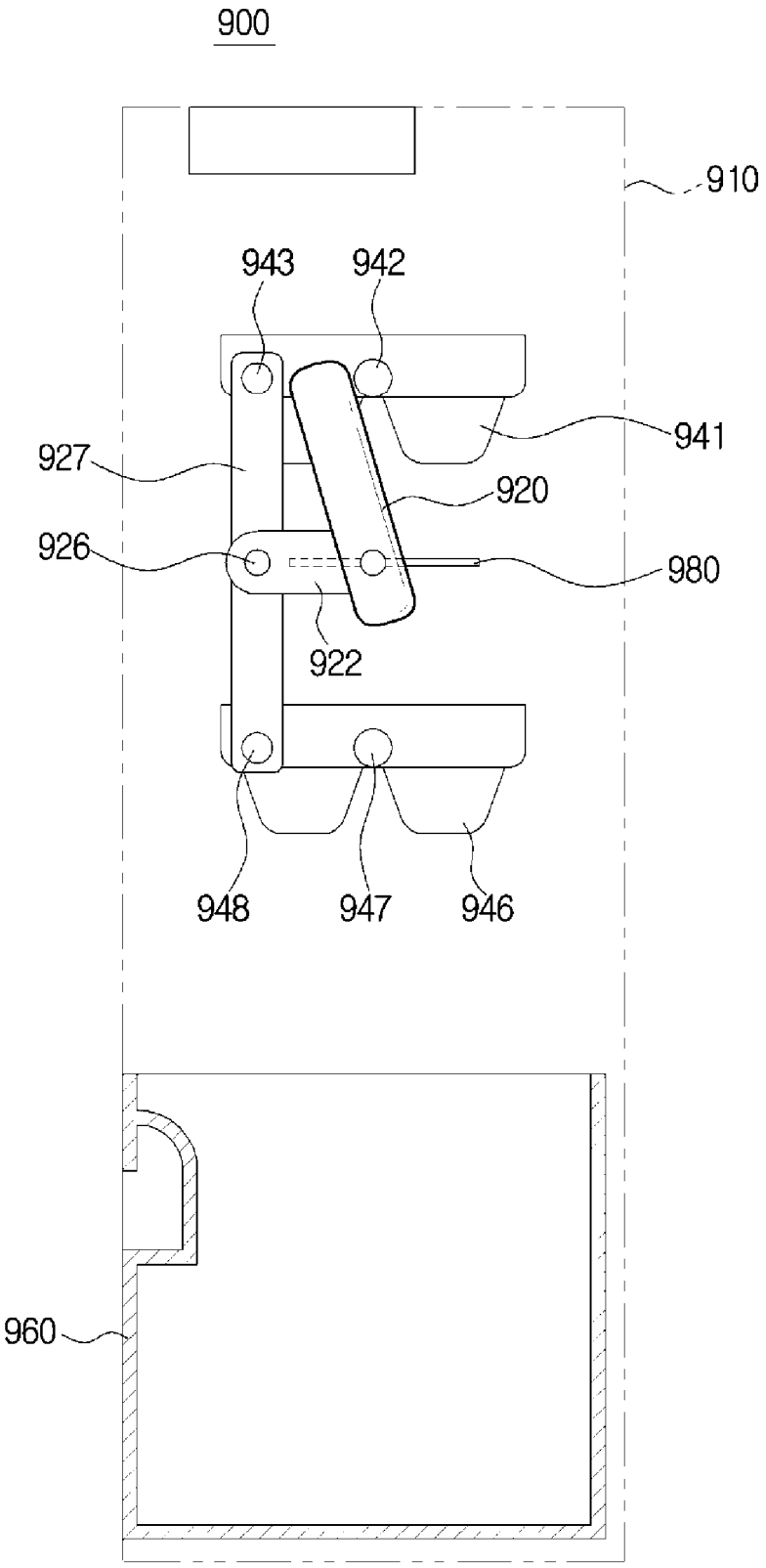
FIGS. 35 and 36 are views illustrating a configuration and an ice moving structure of an ice maker according to a ninth embodiment of the disclosure.
Figure 36:
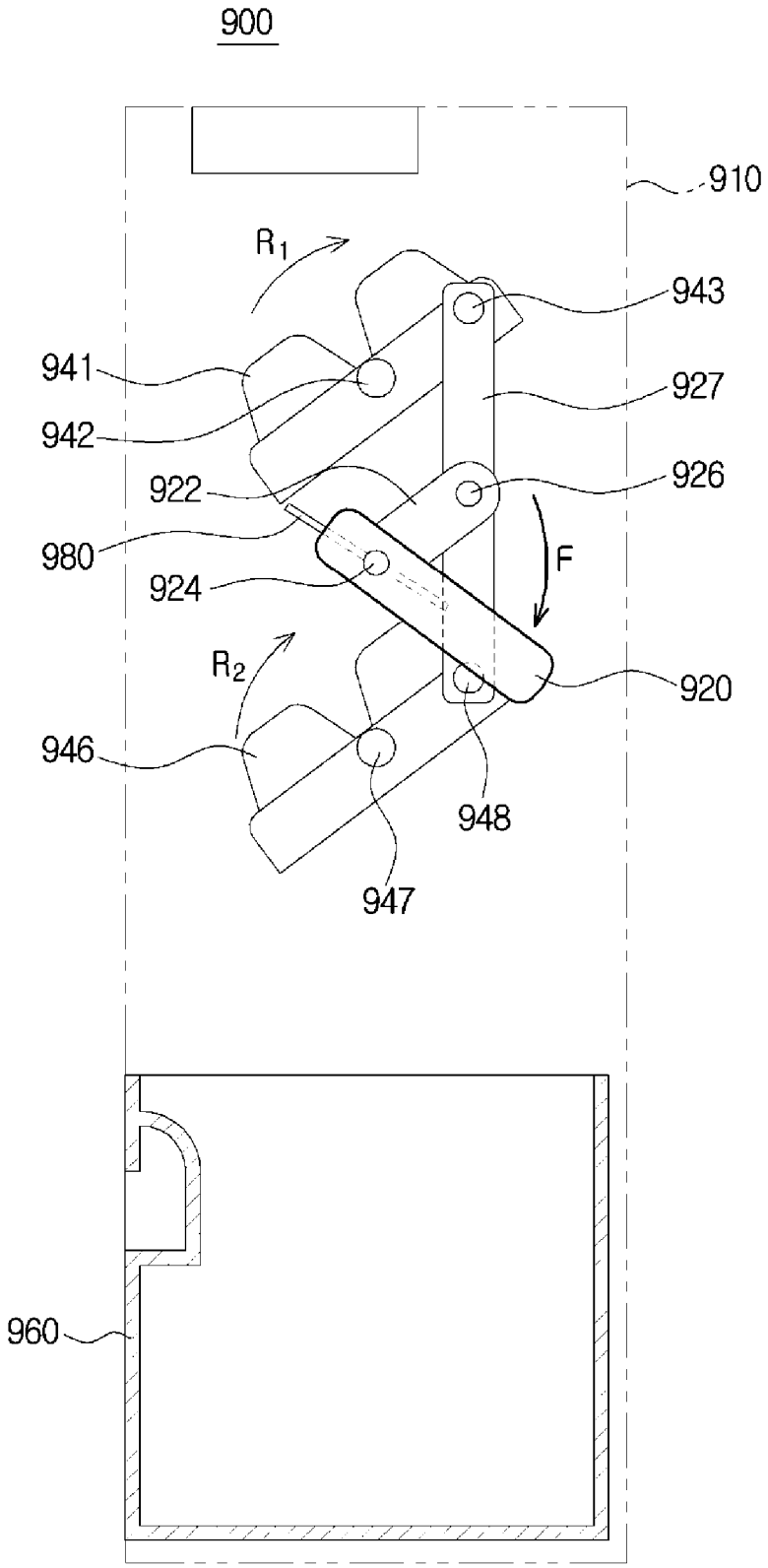

FIGS. 35 and 36 are views illustrating a configuration and an ice separating structure of an ice maker according to a ninth embodiment of the disclosure.

The ice maker according to the ninth embodiment of the disclosure will be described with reference to FIGS. 35 and 36. Like reference numerals refer to like elements as the embodiments described above, and descriptions thereof will be omitted.

In the eighth embodiment, the ice holding preventing member 880 which guides ice not to allow ice falling from an ice making tray on top to be caught by an ice making tray on bottom is provided at the first ice making tray 841. However, an ice holding preventing member 980 may be provided separately from ice making trays 941 and 946.

An ice maker 900 may include a plurality of ice making trays 941 and 946 in which water is stored and frozen to make ice, a supporting frame 910 which supports the ice making trays 941 and 946, a lever 920 manually operated to separate the ice from the plurality of ice making trays 941 and 946, a link unit which connects the lever 920 to the plurality of ice making trays 941 and 946 to transfer a separating force to each of the plurality of ice making trays 941 and 946 when the lever 920 is operated, and an ice bucket 960 provided to store the ice separated from the ice making trays 941 and 946.

The plurality of ice making trays 941 and 946 may be mutually vertically arranged. In the embodiment, two such ice making trays 941 and 946 may be provided, but the number of ice making trays 941 and 946 may be three or more.

The ice making trays 941 and 946 may include a plurality of ice making cells which store water, and may be provided to be rotatable to separate ice from the plurality of ice making cells.

For this, the ice making trays 941 and 946 may include rotating shafts 942 and 947. The rotating shafts 942 and 947 may protrude in longitudinal directions of the ice making trays 941 and 946.

The ice making trays 941 and 946 may respectively include connecting pins 943 and 948 connected to a connecting member 927 of the link unit. The link unit may include a link shaft 922 and the connecting member 927.

The link shaft 922 may include a handle coupling portion which is coupled to the lever 920, a first shaft portion 924 rotatably inserted in a link shaft accommodating groove of the supporting frame 910, a second shaft portion 926 which rotates and is eccentric with the first shaft portion 924, and an extending portion which connects the first shaft portion 924 to the second shaft portion 926.

The ice holding preventing member 980 may be provided between the first ice making tray 941 and the second ice making tray 946. The ice holding preventing member 980 may be initially positioned to be approximately horizontal and may interact with the lever 920 to be inclined when the lever 920 is operated. An interacting structure between the lever 920 and the ice holding preventing member 980 may be configured using various publicly known methods.

The ice holding preventing member 980 may be formed of a flexible material such as silicone, and may include a slit (not shown) through which cool air passes such that circulation of the cool air is not interfered with.

As shown in FIG. 35, the first rotating shaft 942 of the first ice making tray 941 and the second rotating shaft 947 of the second ice making tray 946 may be positioned on the same vertical line.

The first connecting pin 943 of the first ice making tray 941 may be positioned in front of the first rotating shaft 942, and the second connecting pin 948 of the second ice making tray 946 may be positioned in front of the second rotating shaft 947.

As shown in FIG. 36, when the lever 920 is rotated in a direction F, torque is transferred to the first ice making tray 941 and the second ice making tray 946 through the link unit.

Accordingly, the first ice making tray 941 rotates in a direction R1 and the second ice making tray 946 rotates in a direction R2.

Here, the ice holding preventing member 980 provided between the first ice making tray 941 and the second ice making tray 946 rotates to be inclined and guides ice separated from the first ice making tray 941 not to be caught by the second ice making tray 946 and to enter the ice bucket 960.

Due to the configuration described above, the ice maker 900 may move the plurality of ice making trays 941 and 946 vertically arranged together using one lever 920.

Also, when the lever 920 is operated, the ice holding preventing member 980 is disposed between the first ice making tray 941 on top and the second ice making tray 946 on bottom to be inclined such that ice falling from the first ice making tray 941 on top may not be caught by the second ice making tray 946 on bottom and may enter the ice bucket 960.

Accordingly, it is possible to design a slim forward-and-backward width of an ice maker including a plurality of ice making trays vertically arranged.

Figure 37:
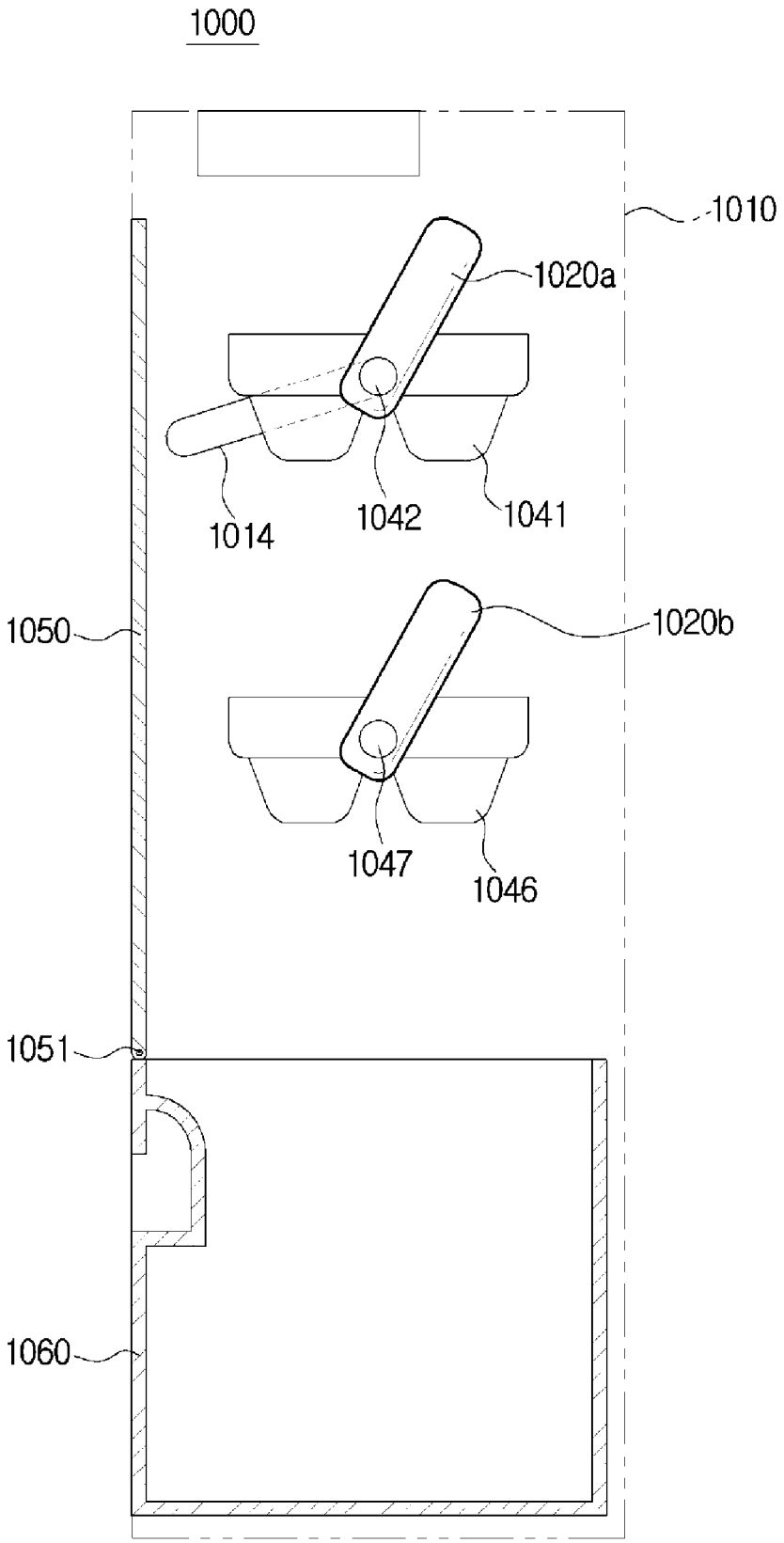
FIGS. 37 and 38 are views illustrating a configuration and an ice moving structure of an ice maker according to a tenth embodiment of the disclosure.
Figure 38:
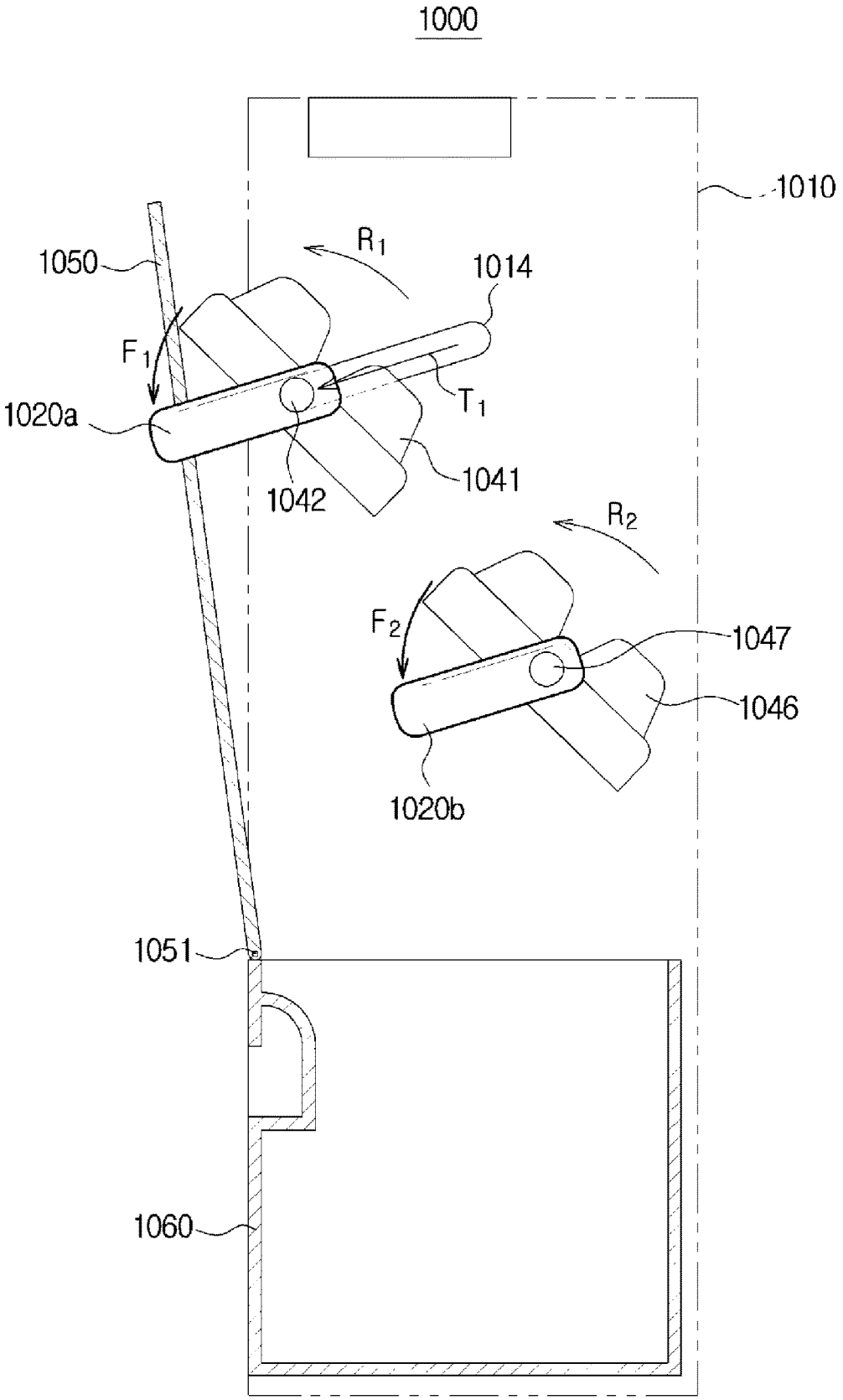

FIGS. 37 and 38 are views illustrating a configuration and an ice moving structure of an ice maker according to a tenth embodiment of the disclosure.

An ice maker 1000 according to the tenth embodiment of the disclosure will be described with reference to FIGS. 37 and 38. Like reference numerals refer to like elements as the embodiments described above, and descriptions thereof will be omitted.

In the embodiments described above, an ice making tray on top and an ice making tray on bottom interact with each other through one lever to separate ice therefrom. However, an ice making tray 1041 on top and an ice making tray 1046 on bottom may independently move to separate ice therefrom.

The first ice making tray 1041 on top may include a first rotating shaft 1042 and a first lever 1020*a* for separating ice, and the second ice making tray 1046 may include a second rotating shaft 1047 and a second lever 1020*b* for separating ice.

The first rotating shaft 1042 of the first ice making tray 1041 on top and the rotating shaft 1047 of the second ice making tray 1046 on bottom may be positioned on the same vertical line.

The first rotating shaft 1042 of the first ice making tray 1041 on top is movably inserted in a linear movement guiding groove 1014 of a supporting frame 1010 such that the first ice making tray 1041 may linearly move with rotation.

The ice maker 1000 may further include an ice guiding member 1050 which guides ice, which is separated from the first ice making tray 1041 and falls while the first ice making tray 1041 on top linearly moves forward, to the ice bucket 1060.

The ice guiding member 1050 may include a rotating pin 1051 which protrudes from a lower end, and the rotating pin 1051 may be rotatably coupled to the supporting frame 1010. The ice guiding member 1050 may be initially closed, and then may be pressurized by the first ice making tray 1041 to be opened and inclined forward when the first ice making tray 1041 linearly moves forward. Accordingly, it is possible to guide the ice falling from the first ice making tray 1041 to enter the ice bucket 1060.

Due to this configuration, since the first ice making tray 1041 linearly moves forward while the lever 1020*a* is operated, ice falling from the first ice making tray 1041 may not be caught by the second ice making tray 1046 and may enter the ice bucket 1060.

Also, as the ice guiding member 1050 rotates forward when the lever 1020*a* is operated, the ice falling from the first ice making tray 1041 may be guided by the ice guiding member 1050 to the ice bucket 1060.

Accordingly, it is possible to design a slim forward-and-backward width of an ice maker including a plurality of ice making trays vertically arranged.

As is apparent from the above description, it is possible to easily supply a required amount of water to an ice making tray and to prevent an overflow or splash of the water while the water is supplied to the ice making tray.

In an ice maker including a plurality of ice making trays vertically arranged, a thickness of the ice maker may be improved and ice separated from an upper ice making tray may not be caught by a lower ice making tray.

Although embodiments of the disclosure have been shown and described, it should be appreciated by those skilled in the art that changes may be made to these embodiments without departing from the principles and spirit of the disclosure, the scope of which is defined in the claims and their equivalents.

What is claimed is:

1. A refrigerator comprising:

a body;

a door;

a storage compartment formed by the body and the door; and an ice maker provided at the storage compartment, the ice maker comprising:

a supporting frame, at least one ice making tray, a water pocket configured to store water, mounted on the supporting frame, and rotatable from a first position on the supporting frame to a second position on the supporting frame so as to supply the water stored in the water pocket to the at least one ice making tray, and a water supply guide mounted on the supporting frame and configured to guide the water supplied from the water pocket to the at least one ice making tray, wherein the water pocket is configured to rotate relative to the water supply guide.

2. The refrigerator of claim 1, wherein the water supply guide comprises a drip tray which receives the water supplied from the water pocket and a channel which guides water received by the drip tray to the ice making tray.

3. The refrigerator of claim 1, wherein the at least one ice making tray comprises a plurality of ice making trays, and the water pocket comprises a plurality of water storage spaces which store water that is supplied to the plurality of ice making trays.

4. The refrigerator of claim 3, wherein the water pocket further comprises a rear wall and an intermediate wall which partitions the plurality of water storage spaces, and a gap is formed between the intermediate wall and the rear wall to supply other water storage spaces with water when the water is supplied to any one of the plurality of water storage spaces.

5. The refrigerator of claim 4, wherein the water supply guide comprises a plurality of troughs which receive the water supplied from the plurality of water storage spaces, and a partitioning rib which partitions the plurality of troughs, and the water pocket comprises a partitioning rib insertion groove in which the partitioning rib is inserted to prevent mixture of the water between the plurality of water storage spaces.

6. The refrigerator of claim 1, wherein the water pocket is manually rotatable to the second position after being mounted to the supporting frame in the first position.

7. The refrigerator of claim 1, wherein the supporting frame comprises a water pocket mount on which the water pocket is mounted.

8. The refrigerator of claim 7, wherein the supporting frame comprises a water pocket support which supports the water pocket to maintain the water pocket mounted on the water pocket mount in the first position.

9. The refrigerator of claim 1, wherein the water pocket comprises a rotating pin, and the supporting frame comprises a rotating pin receiver in which the rotating pin is insertable.

10. The refrigerator of claim 1, wherein the water pocket comprises a rotating protrusion, and the supporting frame comprises a rotation guide groove which guides rotation of the rotating protrusion of the water pocket.

11. The refrigerator of claim 7, wherein the water pocket is configured to horizontally enter the water pocket mount to be mounted thereon.

12. The refrigerator of claim 11, wherein the supporting frame comprises a sidewall support, and the sidewall support comprises a water pocket through hole provided to allow the water pocket to pass therethrough.

13. A refrigerator comprising:

a body;

a door;

a storage compartment formed by the body and the door; and an ice maker provided at the storage compartment, the ice maker comprising:

a supporting frame, a plurality of ice making trays, a water pocket configured to store water, mounted on the supporting frame, and rotatable from a first position on the supporting frame to a second position on the supporting frame so as to supply the water stored in the water pocket to the plurality of ice making trays, and a water supply guide configured to guide the water supplied from the water pocket to the plurality of ice making trays, wherein the water pocket comprises a plurality of water storage spaces which store water that is supplied to the plurality of ice making trays, the water pocket further comprises a rear wall and an intermediate wall which partitions the plurality of water storage spaces, and a gap is formed between the intermediate wall and the rear wall to supply other water storage spaces with water when the water is supplied to any one of the plurality of water storage spaces.

* * * * *